US010188916B2

(12) United States Patent
Harbert et al.

(10) Patent No.: US 10,188,916 B2
(45) Date of Patent: Jan. 29, 2019

(54) GOLF CLUB HEAD

(71) Applicant: Taylor Made Golf Company, Inc., Carlsbad, CA (US)

(72) Inventors: Christopher J. Harbert, Carlsbad, CA (US); Jake Feuerstein, San Diego, CA (US); Mattieu Bovee, Oceanside, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

(21) Appl. No.: 15/859,297

(22) Filed: Dec. 29, 2017

(65) Prior Publication Data

US 2018/0345093 A1 Dec. 6, 2018

Related U.S. Application Data

(60) Provisional application No. 62/515,401, filed on Jun. 5, 2017.

(51) Int. Cl.
*A63B 53/04* (2015.01)

(52) U.S. Cl.
CPC .... *A63B 53/0466* (2013.01); *A63B 2053/045* (2013.01); *A63B 2053/0412* (2013.01); *A63B 2053/0495* (2013.01)

(58) Field of Classification Search
CPC ..... A63B 53/0466
See application file for complete search history.

(56) References Cited

U.S. PATENT DOCUMENTS

| | | | |
|---|---|---|---|
| 6,773,360 | B2 | 8/2004 | Willett et al. |
| 6,800,038 | B2 | 10/2004 | Willett et al. |
| 6,824,475 | B2 | 11/2004 | Burnett et al. |
| 6,997,820 | B2 | 2/2006 | Willett et al. |
| 7,140,974 | B2 | 11/2006 | Chao et al. |
| 7,166,040 | B2 | 1/2007 | Chao et al. |
| 7,186,190 | B1 | 3/2007 | Beach et al. |
| 7,223,180 | B2 | 5/2007 | Willett et al. |
| 7,267,620 | B2 | 9/2007 | Chao et al. |
| 7,407,447 | B2 | 8/2008 | Beach et al. |

(Continued)

OTHER PUBLICATIONS

Kozuchowski, Callaway Big Bertha and Big Bertha Alpha drivers, Golf RX, Dec. 2, 2013, download available at http://www.golfwrx.com/154230/callaway-big-bertha-and-big-bertha-alpha-drivers/ on May 2, 2018.

(Continued)

*Primary Examiner* — Michael Dennis
(74) *Attorney, Agent, or Firm* — Kunzler, PC

(57) ABSTRACT

Disclosed herein is a golf club head comprising a body, at least one weight assembly, and at least one brace bar. The body defines an interior cavity and a face portion at the forward region of the body and comprising a strike face with an area of at least 3000 mm^2 and a maximum height from a ground plane of at least about 50 mm. The body further comprises at least one weight track formed in the sole portion. The at least one weight assembly is selectively adjustably positioned within the at least one weight track. The at least one brace bar traverses the interior cavity between and is attached to the at least one weight track and the crown portion. A mass per unit length of the brace bar is between 0.005 g/mm and 0.40 g/mm.

22 Claims, 16 Drawing Sheets

(56) References Cited

U.S. PATENT DOCUMENTS

| | | | | |
|---|---|---|---|---|
| 7,410,425 | B2 | 8/2008 | Willett et al. | |
| 7,410,426 | B2 | 8/2008 | Willett et al. | |
| 7,419,441 | B2 | 9/2008 | Hoffman et al. | |
| 7,448,963 | B2 | 11/2008 | Beach et al. | |
| 7,452,285 | B2 | 11/2008 | Chao et al. | |
| 7,530,904 | B2 | 5/2009 | Beach et al. | |
| 7,540,811 | B2 | 6/2009 | Beach et al. | |
| 7,568,985 | B2 | 8/2009 | Beach et al. | |
| 7,578,753 | B2 | 8/2009 | Beach et al. | |
| 7,591,738 | B2 | 9/2009 | Beach et al. | |
| 7,621,823 | B2 | 11/2009 | Beach et al. | |
| 7,628,707 | B2 | 12/2009 | Beach et al. | |
| 7,628,712 | B2 | 12/2009 | Chao et al. | |
| 7,632,194 | B2 | 12/2009 | Beach et al. | |
| 7,713,142 | B2 | 5/2010 | Hoffman et al. | |
| 7,717,804 | B2 | 5/2010 | Beach et al. | |
| 7,717,805 | B2 | 5/2010 | Beach et al. | |
| 7,744,484 | B1 | 6/2010 | Chao et al. | |
| RE41,577 | E | 8/2010 | McLean | |
| 7,775,905 | B2 | 8/2010 | Beach et al. | |
| 7,846,041 | B2 | 12/2010 | Beach et al. | |
| 7,874,936 | B2 | 1/2011 | Chao et al. | |
| 7,874,937 | B2 | 1/2011 | Chao et al. | |
| 7,874,938 | B2 | 1/2011 | Chao et al. | |
| 7,963,861 | B2 | 6/2011 | Beach et al. | |
| RE42,544 | E | 7/2011 | Chao et al. | |
| 7,985,146 | B2 | 7/2011 | Lin et al. | |
| 8,012,038 | B1 | 9/2011 | Beach et al. | |
| 8,025,587 | B2 | 9/2011 | Beach et al. | |
| 8,096,897 | B2 | 1/2012 | Beach et al. | |
| 8,235,831 | B2 | 8/2012 | Beach et al. | |
| 8,303,431 | B2 | 11/2012 | Beach et al. | |
| 8,337,319 | B2 | 12/2012 | Sargent et al. | |
| 8,353,786 | B2 | 1/2013 | Beach et al. | |
| 8,444,505 | B2 | 5/2013 | Beach et al. | |
| 8,628,434 | B2 | 1/2014 | Chao et al. | |
| 8,734,271 | B2 | 5/2014 | Beach et al. | |
| 8,870,678 | B2 | 10/2014 | Beach et al. | |
| 9,033,821 | B2 | 5/2015 | Beach et al. | |
| 9,174,096 | B2 | 11/2015 | Sargent et al. | |
| 9,211,453 | B1 * | 12/2015 | Foster | A63B 53/06 |
| 9,259,625 | B2 | 2/2016 | Sargent et al. | |
| 9,675,856 | B1 * | 6/2017 | Gibbs | A63B 53/0466 |
| 9,795,840 | B2 | 10/2017 | Greensmith et al. | |
| 9,914,028 | B1 * | 3/2018 | Cleghorn | A63B 53/0466 |
| 10,086,240 | B1 | 10/2018 | Hoffman et al. | |
| 2008/0149267 | A1 | 6/2008 | Chao et al. | |
| 2009/0163289 | A1 | 6/2009 | Chao et al. | |
| 2011/0152000 | A1 | 6/2011 | Sargent et al. | |
| 2011/0312437 | A1 | 12/2011 | Sargent et al. | |
| 2012/0071264 | A1 | 3/2012 | Beach et al. | |
| 2012/0122601 | A1 | 5/2012 | Beach et al. | |
| 2012/0258818 | A1 | 10/2012 | Beach et al. | |
| 2013/0123040 | A1 | 5/2013 | Willett et al. | |
| 2015/0375070 | A1 | 12/2015 | Beach et al. | |
| 2016/0001146 | A1 | 1/2016 | Sargent et al. | |
| 2016/0023060 | A1 | 1/2016 | Harbert et al. | |
| 2016/0023063 | A1 | 1/2016 | Willet et al. | |
| 2016/0059093 | A1 * | 3/2016 | Nielson | A63B 53/02 473/338 |
| 2016/0059094 | A1 | 3/2016 | Mata et al. | |
| 2017/0072277 | A1 | 3/2017 | Mata et al. | |

OTHER PUBLICATIONS

Procedure for Measuring the Club Head Size of Wood Clubs, United States Golf Association and R&A Rules Limited, Revision 1.0.0, Nov. 21, 2003, pp. 1-6.

Hopley, Callaway Great Big Bertha Driver Review, Golfalot, Aug. 4, 2015. download available at http://www.golfalot.com/equipment-reviews/callaway-great-big-bertha-driver-review-3308.aspx on Oct. 11, 2018.

* cited by examiner

GOLF CLUB HEAD

CROSS-REFERENCE TO RELATED APPLICATIONS

This application claims the benefit of U.S. Provisional Patent Application No. 62/515,401, filed Jun. 5, 2017, which is incorporated herein by reference in its entirety. This application references U.S. patent application Ser. No. 15/259,026, filed Sep. 7, 2016, which is a continuation-in-part of U.S. patent application Ser. No. 15/255,638, filed Sep. 2, 2016, which is a continuation-in-part of U.S. patent application Ser. No. 15/087,002, filed on Mar. 31, 2016, which application claims the benefit of U.S. Provisional Patent Application No. 62/205,601, filed on Aug. 14, 2015, all of which are incorporated herein by reference in their entireties.

FIELD

This disclosure relates generally to golf clubs, and more particularly to a hollow-cavity head of a driver-type golf club.

BACKGROUND

Modern "wood-type" golf clubs (notably, "drivers," "fairway woods," and "utility or hybrid clubs"), are generally called "metalwoods" since they tend to be made of strong, lightweight metals, such as titanium. An exemplary metalwood golf club, such as a driver or fairway wood, typically includes a hollow shaft and a club head coupled to a lower end of the shaft. Most modern versions of club heads are made, at least in part, from a lightweight but strong metal, such as a titanium alloy. In most cases, the golf club head is includes a hollow body to which a face plate, or face portion, is attached or integrally formed. The face portion has a front surface, known as a striking face, configured to contact the golf ball during a proper golf swing.

Center-of-gravity (CG) and mass moments of inertia critically affect a golf club head's performance, such as launch angle and flight trajectory on impact with a golf ball, among other characteristics.

A mass moment of inertia is a measure of a club head's resistance to twisting about the golf club head's center-of-gravity, for example on impact with a golf ball. In general, a moment of inertia of a mass about a given axis is proportional to the square of the distance of the mass away from the axis. In other words, increasing distance of a mass from a given axis results in an increased moment of inertia of the mass about that axis. Higher golf club head moments of inertia result in lower golf club head rotation on impact with a golf ball, particularly on "off-center" impacts with a golf ball, e.g., mis-hits. Lower rotation in response to a mis-hit results in a player's perception that the club head is forgiving. Generally, one measure of "forgiveness" can be defined as the ability of a golf club head to reduce the effects of mis-hits on flight trajectory and shot distance, e.g., hits resulting from striking the golf ball at a less than ideal impact location on the golf club head. Greater forgiveness of the golf club head generally equates to a higher probability of hitting a straight golf shot. Moreover, higher moments of inertia typically result in greater ball speed on impact with the golf club head, which can translate to increased golf shot distance.

Most fairway wood club heads are intended to hit the ball directly from the ground, e.g., the fairway, although many golfers also use fairway woods to hit a ball from a tee. Accordingly, fairway woods are subject to certain design constraints to maintain playability. For example, compared to typical drivers, which are usually designed to hit balls from a tee, fairway woods often have a relatively shallow head height, providing a relatively lower center of gravity and a smaller top view profile for reducing contact with the ground. Such fairway woods inspire confidence in golfers for hitting from the ground. Also, fairway woods typically have a higher loft than most drivers, although some drivers and fairway woods share similar lofts. For example, most fairway woods have a loft greater than or equal to about 13 degrees, and most drivers have a loft between about 7 degrees and about 15 degrees.

Faced with constraints such as those just described, golf club manufacturers often must choose to improve one performance characteristic at the expense of another. For example, some conventional golf club heads offer increased moments of inertia to promote forgiveness while at the same time incurring a higher than desired CG-position and increased club head height. Club heads with high CG and/or large height might perform well when striking a ball positioned on a tee, such is the case with a driver, but not when hitting from the turf. Thus, conventional golf club heads that offer increased moments of inertia for forgiveness often do not perform well as a fairway wood club head.

Although traditional fairway wood club heads generally have a low CG relative to most traditional drivers, such clubs usually also suffer from correspondingly low mass moments of inertia. In part due to their relatively low CG, traditional fairway wood club heads offer acceptable launch angle and flight trajectory when the club head strikes the ball at or near the ideal impact location on the ball striking face. But because of their low mass moments of inertia, traditional fairway wood club heads are less forgiving than club heads with high moments of inertia, which heretofore have been drivers. As already noted, conventional golf club heads that have increased mass moments of inertia, and thus are more forgiving, have a relatively high CG.

Accordingly, to date, golf club designers and manufacturers have not offered golf club heads with high moments of inertia for improved forgiveness and low center-of-gravity.

A continual challenge to improving performance in woods is generating ballspeed. In addition to the center of gravity and center of gravity projection, the geometry of the face and clubhead play a major role in determining initial ball velocity.

SUMMARY

The subject matter of the present application has been developed in response to the present state of the art, and in particular, in response to the shortcomings of golf clubs and associated golf club heads, that have not yet been fully solved by currently available techniques. Accordingly, the subject matter of the present application has been developed to provide a golf club and golf club head that overcome at least some of the above-discussed shortcomings of prior art techniques.

The golf club heads described herein may include a driver-type golf club heads with a relatively large striking face area of at least 3500 mm^2, preferably at least 3800 mm^2, and even more preferably at least 3900 mm^2. Additionally, the driver-type golf club heads may include a center of gravity (CG) projection proximate center face that may be at most 3 mm above or below center face, and preferably may be at most 1 mm above or below center face as measured along a vertical axis (z-axis). Moreover, the driver-type golf club heads may have a relatively high moment of inertia about the vertical z-axis e.g. Izz>350 kg-mm^2 and preferably Izz>400 kg-mm^2, a relatively high moment of inertia about the horizontal x-axis e.g. Ixx>200 kg-mm^2 and preferably Ixx>250 kg-mm^2, and preferably a ratio of Ixx/Izz>0.55. However, the golf club head of the present disclosure, at least partially due to the brace bars, crown and sole inserts, weight track configuration, and weight assembly configuration is capable of achieving an Izz of 426 kg-mm^2 and an Ixx of 283 kg-mm^2 for a ratio of 0.6643.

Disclosed herein is a golf club head comprising a body, at least one weight assembly, and at least one brace bar. The body defines an interior cavity. The body comprises a sole portion, positioned at a bottom portion of the golf club head, a crown portion, positioned at a top portion of the golf club head, a skirt portion, positioned around a periphery of the golf club head between the sole portion and the crown portion, a forward region, a rearward region. The body also comprises a face portion at the forward region of the body and comprising a strike face with an area of at least 3000 mm^2 and a maximum height from a ground plane of at least about 50 mm. The body further comprises at least one weight track formed in the sole portion. The at least one weight assembly is selectively adjustably positioned within the at least one weight track. The at least one brace bar traverses the interior cavity between and is attached to the at least one weight track and the crown portion. A mass per unit length of the brace bar is between 0.005 g/mm and 0.40 g/mm. The preceding subject matter of this paragraph characterizes example 1 of the present disclosure.

The body further comprises a frame. The frame comprises a first crown opening, a second crown opening, and a spine portion defining the crown portion and separating the first crown opening from the second crown opening. The crown portion comprises a crown insert attached to the spine portion and covering the first crown opening and the second crown opening. The at least one brace bar is attached to the spine portion. The preceding subject matter of this paragraph characterizes example 2 of the present disclosure, wherein example 2 also includes the subject matter according to example 1, above.

The frame further comprises a first receptacle co-formed with the at least one weight track and a second receptacle co-formed with the spine portion. The at least one brace bar is received within and is attached to the first receptacle and the second receptacle. The preceding subject matter of this paragraph characterizes example 3 of the present disclosure, wherein example 3 also includes the subject matter according to example 2, above.

The golf club head further comprises a hosel coupled to body. The body further comprises a hosel-brace reinforcement rib within the interior cavity of the body and extending continuously between, and coupled directly to, the hosel and the first receptacle. The preceding subject matter of this paragraph characterizes example 4 of the present disclosure, wherein example 4 also includes the subject matter according to example 3, above.

The body further comprises a spine reinforcement rib within the interior cavity of the body and extending along and coupled directly to the spine portion of the frame and the second receptacle. The preceding subject matter of this paragraph characterizes example 5 of the present disclosure, wherein example 5 also includes the subject matter according to any one of examples 3 or 4, above.

The at least one brace bar comprises a forward brace bar and a rearward brace bar. The forward brace bar and the rearward brace bar are spaced apart and aligned in a forward-to-rearward direction. The preceding subject matter of this paragraph characterizes example 6 of the present disclosure, wherein example 6 also includes the subject matter according to any one of examples 2-5, above.

The forward brace bar is angled rearwardly relative to a vertical axis. The rearward brace bar is angled forwardly relative to the vertical axis. The preceding subject matter of this paragraph characterizes example 7 of the present disclosure, wherein example 7 also includes the subject matter according to example 6, above.

The at least one weight track comprises a front weight track, extending in a heel-to-toe direction substantially parallel with the strike face of the face portion. The at least one weight track further comprises an intermediate weight track, extending in a front-to-rear direction substantially perpendicular to the strike face of the face portion and separating the first sole opening from the second sole opening. The at least one weight track further comprises a rear weight track, extending at angle relative to the intermediate weight track. The forward brace bar is attached to an intersection between the front weight track and the intermediate weight track at a location forward of a center-of-gravity of the golf club head. The rearward brace bar is attached to an intersection between the intermediate weight track and the rear weight track at a location rearward of the center-of-gravity of the golf club head. The preceding subject matter of this paragraph characterizes example 8 of the present disclosure, wherein example 8 also includes the subject matter according to example 7, above.

The at least one weight track comprises an intermediate weight track, extending in a front-to-rear direction substantially perpendicular to the strike face of the face portion and separating the first sole opening from the second sole opening. The at least one weight track further comprises a rear weight track, extending at angle relative to the intermediate weight track. The brace bar is attached to at least the intermediate weight track. The preceding subject matter of this paragraph characterizes example 9 of the present disclosure, wherein example 9 also includes the subject matter according to any one of examples 2-8, above.

The frame is made of a metal alloy. The crown insert is made of a fiber-reinforced polymer. The preceding subject matter of this paragraph characterizes example 10 of the present disclosure, wherein example 10 also includes the subject matter according to any one of examples 2-9, above.

The frame further comprises a first sole opening and a second sole opening defining the sole portion of the body. The sole portion comprises a first sole insert attached to the frame and covering the first sole opening and a second sole insert attached to the frame and covering the second sole opening. The preceding subject matter of this paragraph characterizes example 11 of the present disclosure, wherein example 11 also includes the subject matter according to any one of examples 2-10, above.

The first sole insert overhangs the at least one weight track. The second sole insert overhangs the at least one weight track. The preceding subject matter of this paragraph characterizes example 12 of the present disclosure, wherein example 12 also includes the subject matter according to example 11, above.

The at least one weight track comprises an intermediate weight track, extending in a front-to-rear direction substantially perpendicular to the strike face of the face portion and separating the first sole opening from the second sole opening. The first sole insert overhangs the intermediate weight track. The second sole insert overhangs the intermediate weight track. The preceding subject matter of this paragraph characterizes example 13 of the present disclosure, wherein example 13 also includes the subject matter according to example 12, above.

The at least one weight track comprises a front weight track, extending in a heel-to-toe direction substantially parallel with the strike face of the face portion. The first sole insert overhangs the front weight track. The second sole insert overhangs the front weight track. The preceding subject matter of this paragraph characterizes example 14 of the present disclosure, wherein example 14 also includes the subject matter according to example 13, above.

The at least one weight comprises a ledge. The at least one weight assembly consists of an inner component and an outer component. The at least one weight assembly is configured to clamp the ledge between the inner component and the outer component. The preceding subject matter of this paragraph characterizes example 15 of the present disclosure, wherein example 15 also includes the subject matter according to any one of examples 1-14, above.

The head further comprises a coefficient of restitution (COR) feature formed in the sole portion of the body between the face portion and the at least one weight track. The preceding subject matter of this paragraph characterizes example 16 of the present disclosure, wherein example 16 also includes the subject matter according to any one of examples 1-15, above.

The at least one weight track comprises an intermediate weight track, extending in a front-to-rear direction substantially perpendicular to the strike face of the face portion and separating the first sole opening from the second sole opening. The COR feature comprises a channel between the face portion and the intermediate weight track and extending perpendicular to the intermediate weight track. The preceding subject matter of this paragraph characterizes example 17 of the present disclosure, wherein example 17 also includes the subject matter according to example 16, above.

The at least one weight assembly is selectively adjustable to adjust a CGy coordinate of the golf club head within a range of adjustability of between 3 mm and 8 mm, a CGx coordinate of the golf club head within a range of adjustability of between 2 mm and 8 mm, and a CGz coordinate of the golf club head within a range of adjustability of no more than 2 mm. The preceding subject matter of this paragraph characterizes example 18 of the present disclosure, wherein example 18 also includes the subject matter according to any one of examples 1-17, above.

Also disclosed herein is a two-piece weight assembly for installing within a weight track of a golf club head. The two-piece weight assembly consists of an inner component and an outer component. The inner component comprises an anchor element and a mating element. The anchor element is round. The outer component comprises a head element that is non-round. The mating element of the inner component is rotatably mateable with the outer component to adjust a distance between the anchor element of the inner component and the head element of the outer component. The preceding subject matter of this paragraph characterizes example 19 of the present disclosure.

The inner component further comprises a neck between the anchor element and the mating element. The neck has a maximum width that is less than that of the anchor element and the mating element. The preceding subject matter of this paragraph characterizes example 20 of the present disclosure, wherein example 20 also includes the subject matter according to example 19, above.

The outer component further comprises a boss protruding from the head element. The boss is positioned between the head element and the anchor element when the mating element of the inner component is rotatably mated with the outer component. The boss is non-round. The preceding subject matter of this paragraph characterizes example 21 of the present disclosure, wherein example 21 also includes the subject matter according to any one of examples 19 or 20, above.

The mating element comprises external threads and a tool engagement socket. The outer component comprises an aperture extending entirely through the outer component. The aperture comprises internal threads threadably engageable with the external threads of the mating element. The preceding subject matter of this paragraph characterizes example 22 of the present disclosure, wherein example 22 also includes the subject matter according to any one of examples 19-21, above.

The head element of the outer component comprises a plurality of alternating recesses and tabs. The preceding subject matter of this paragraph characterizes example 23 of the present disclosure, wherein example 23 also includes the subject matter according to any one of examples 19-22, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Figure 1:
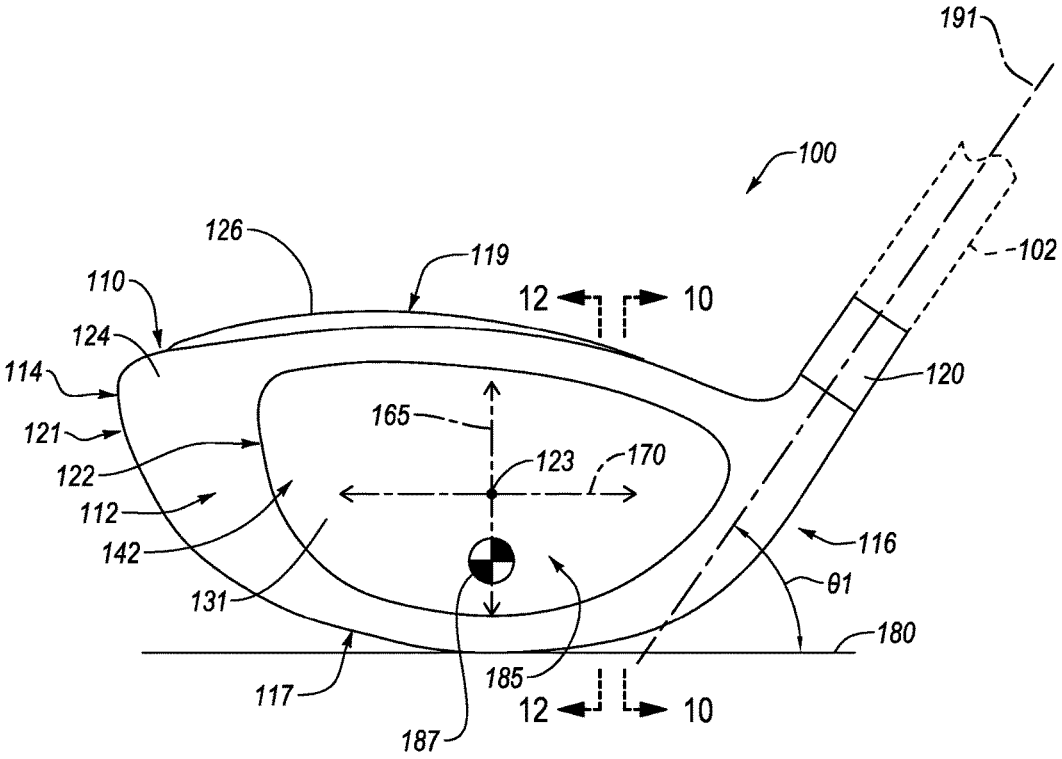
FIG. 1 is a front elevation view of a golf club head, according to one or more examples of the present disclosure.

The following describes embodiments of golf club heads in the context of a driver-type golf club, but the principles, methods and designs described may be applicable in whole or in part to fairway woods, utility clubs (also known as hybrid clubs) and the like.

A golf club head 100, according to one example, is shown in FIGS. 1-4. The golf club head 100 includes a body 110, which is substantially hollow. The body 110 has a toe region 114 and a heel region 116, opposite the toe region 114. The body 110 also has a forward region 112 and a rearward region 118, opposite the forward region 112. The body 110 of the golf club head 100 additionally includes a sole portion 117, defining a bottom of the golf club head 100, and a crown portion 119, opposite the sole portion 117 and defining a top of the golf club head 100. Furthermore, the body 110 includes a face portion 142 at the forward region 112 of the body 110. Described in more detail below, the face portion 142 includes a strike plate 122 with a strike face 131, which is a forward-facing surface of the strike plate 122 that impacts a golf ball during a proper golf swing. Also, the body 110 of the golf club head 100 includes a skirt portion 121 that defines a transition region where the body 110 of the golf club head 100 transitions between the crown portion 119 and the sole portion 117. Accordingly, the skirt portion 121 is located between the crown portion 119 and the sole portion 117.

Figure 2:
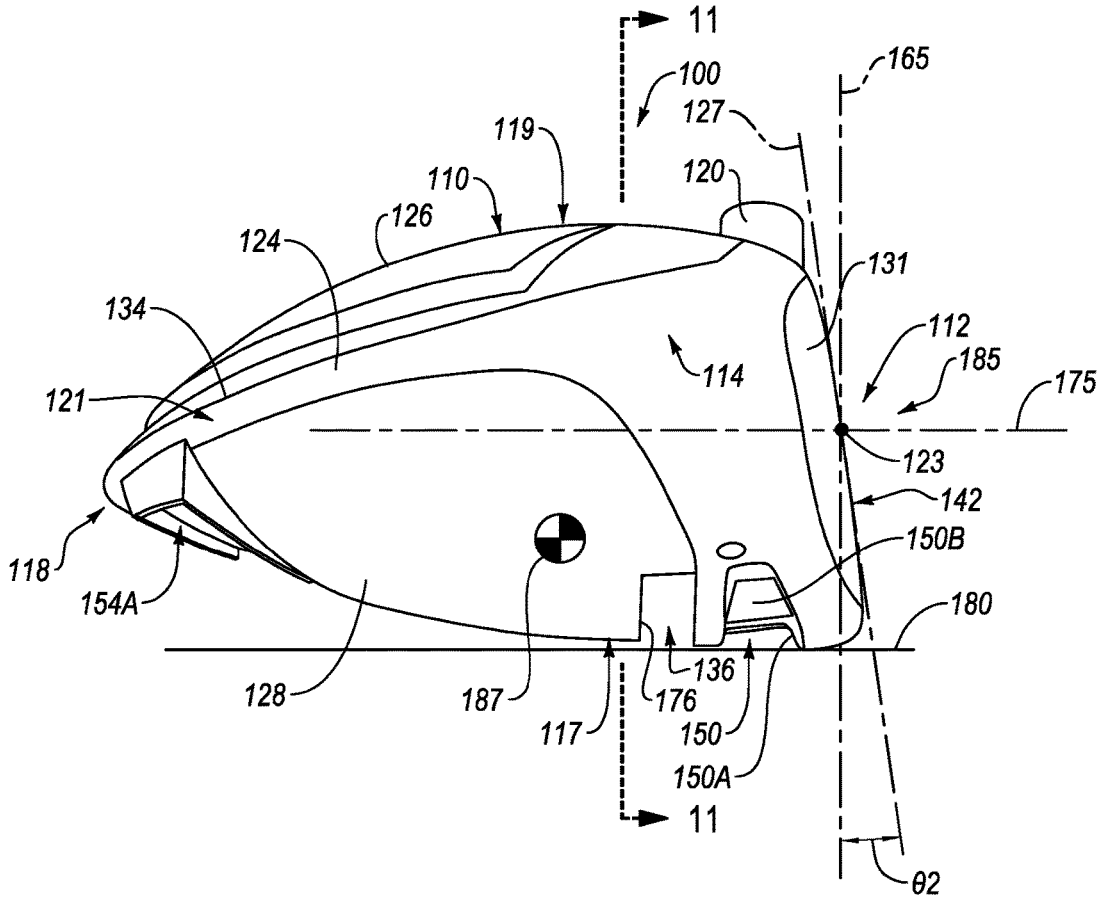
FIG. 2 is a side elevation view of the golf club head of FIG. 1, according to one or more examples of the present disclosure.

As used herein, "crown portion" means an upper portion of the golf club head 100 above a periphery 134 of the club head 100 as viewed from a top-down direction (see, e.g., FIG. 3) and rearward of the topmost portion of the strike face 131. As used herein, "sole portion" means a lower portion of the golf club head 100 extending upwards from a lowest point of the golf club head 100 when the golf club head is at the normal address position. In some implementations, the sole portion 117 extends approximately 50% to 60% of the distance from the lowest point of the golf club head 100 to the crown 119. In other implementations, the sole portion 117 extends upwardly from the lowest point of the golf club head 100 a shorter distance. Further, the sole portion 117 can define a substantially flat portion extending substantially horizontally relative to the ground plane 180 when in normal address position or can have an arced or convex shape as shown in FIGS. 1 and 2. As used herein, "skirt portion" means a side portion of the golf club head 100 between the crown portion 119 and the sole portion 117 that extends across a periphery 134 of the golf club head 100, excluding the strike face 131, from the toe region 114, around the rearward region 118, to the heel region 116. As used herein, "strike face" means a front or external surface of the strike plate 122 of the face portion 142 configured to impact a golf ball. In some embodiments, the strike plate 122 can be attached to the body 110 using known attachment techniques, such as welding, or co-formed with the body 110 to form a one-piece, unitary and monolithic, construction with the body 110. Further, the strike face 131 can have a variable thickness. In certain embodiments, the strike face 131 has a bulge and roll curvature (discussed more fully below).

The golf club head 100 also includes a hosel 120 extending from the heel region 116 of the body 110 of the golf club head 100. As shown in dashed line in FIG. 1, a shaft 102 of a golf club may be attached directly to the hosel 120 or, alternatively, attached indirectly to the hosel 120, such as via a flight control technology (FCT) component (e.g., an adjustable lie/loft assembly) coupled with the hosel 120. The golf club includes a grip (not shown) fitted around a distal end or free end of the shaft 102. The grip of the golf club helps promote the handling of the golf club by a user during a golf swing. The golf club head 100 defines a hosel axis 191, which is coaxial with the shaft 102 and defines a central axis of the hosel 120.

Figure 3:
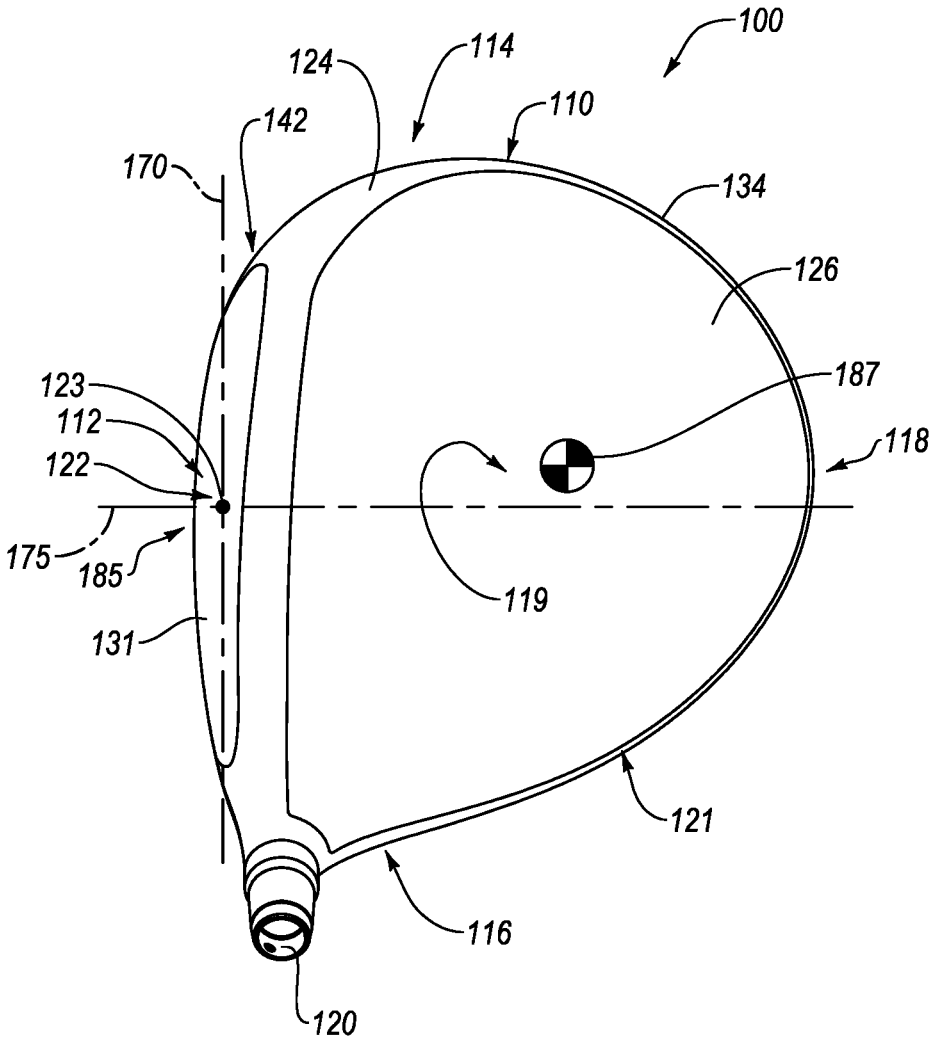
FIG. 3 is top plan view of the golf club head of FIG. 1, according to one or more examples of the present disclosure.
Figure 4:
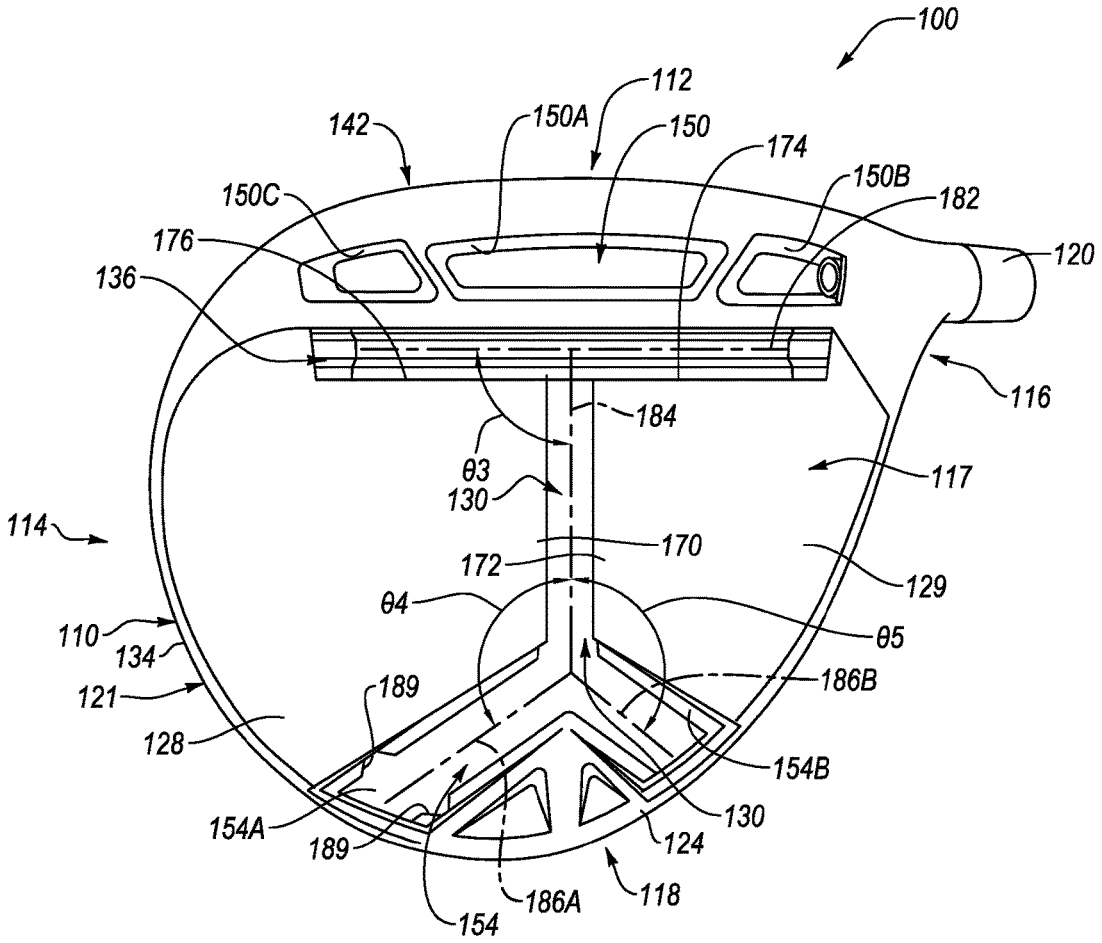
FIG. 4 is a bottom view of the golf club head of FIG. 1, according to one or more examples of the present disclosure.
Figure 5:
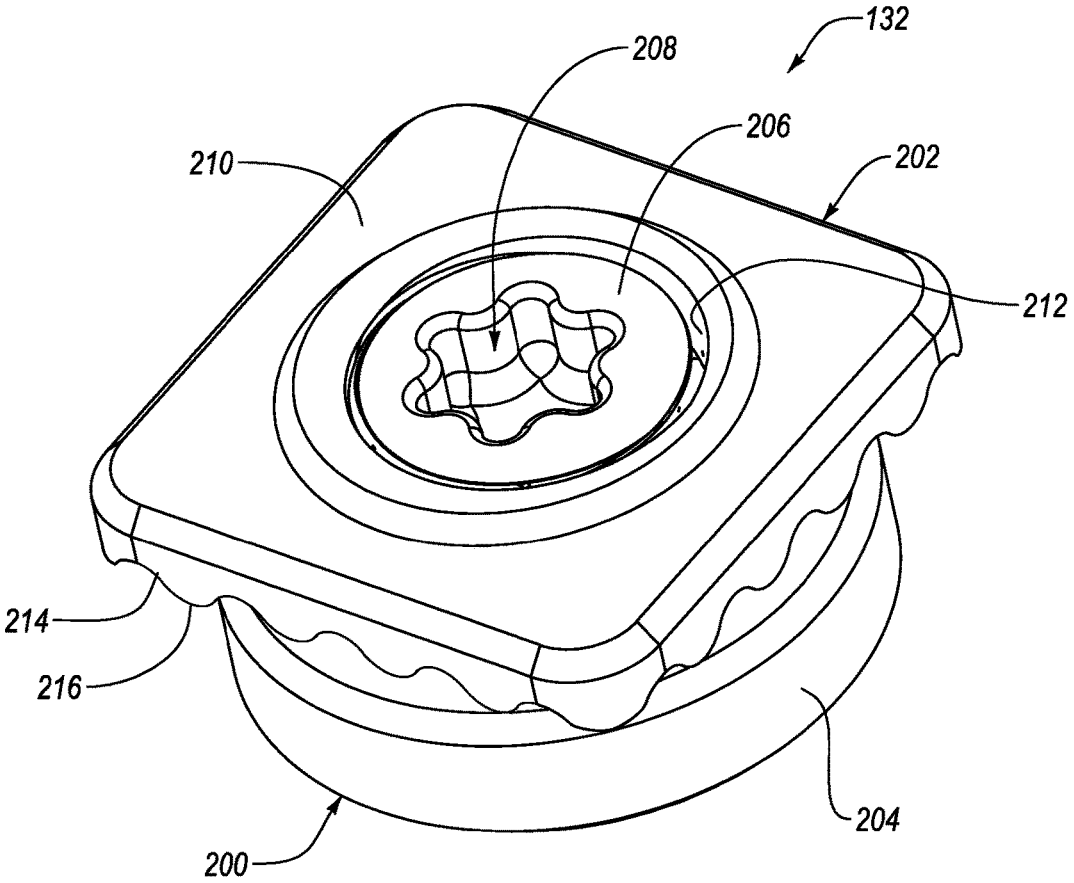
FIG. 5 is a perspective view of a weight assembly of a golf club head, according to one or more examples of the present disclosure.
Figure 6:
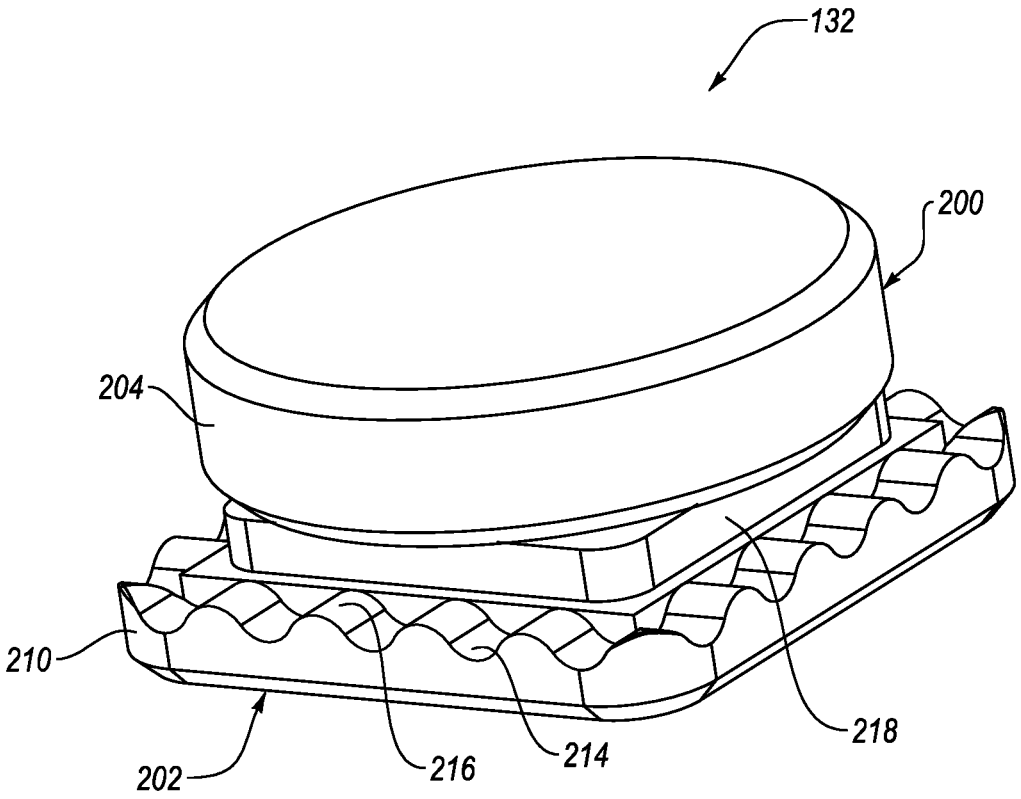
FIG. 6 is another perspective view of the weight assembly of FIG. 5, according to one or more examples of the present disclosure.
Figure 7:
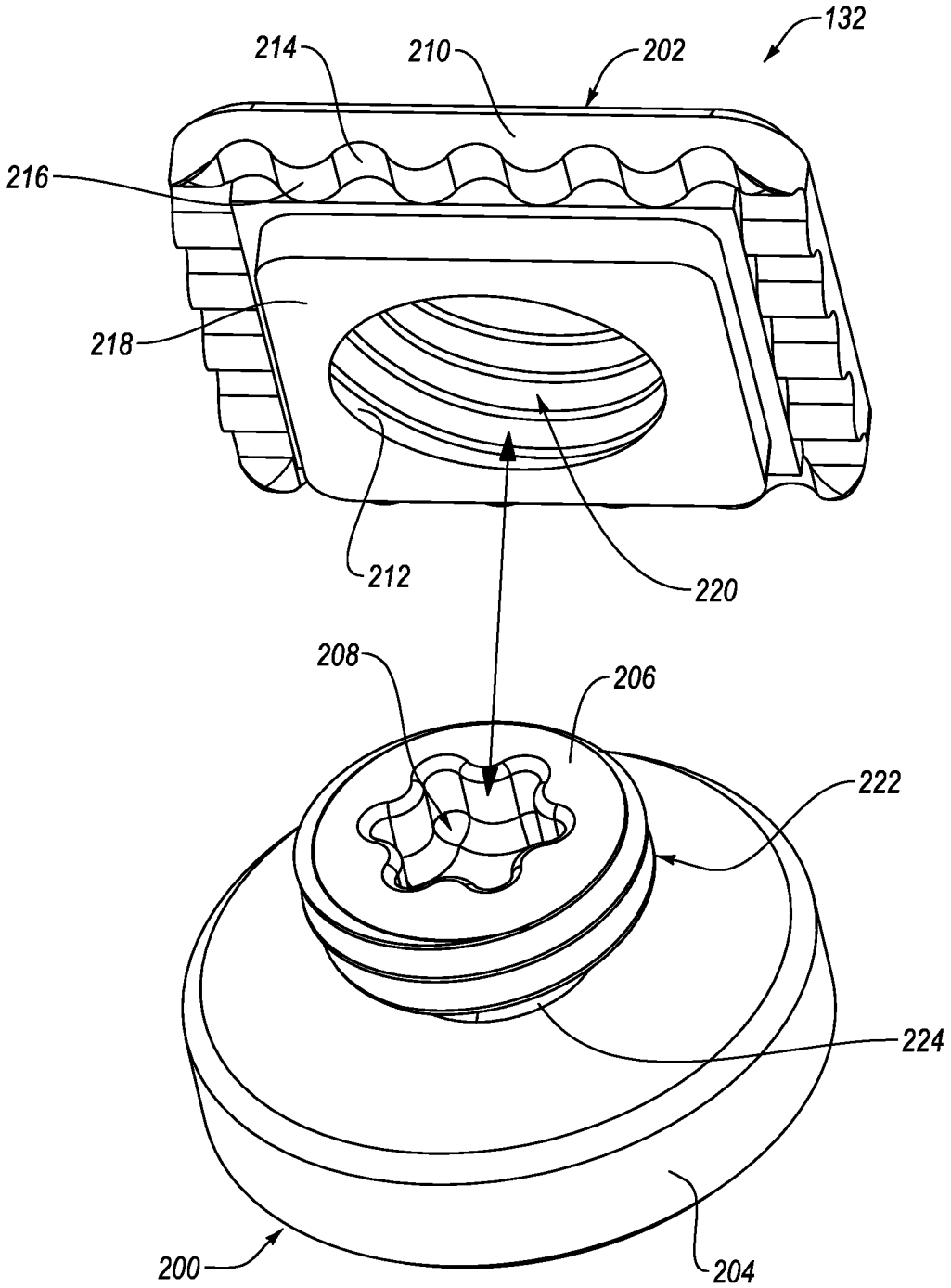
FIG. 7 is an exploded perspective view of the weight assembly of FIG. 5, according to one or more examples of the present disclosure.
Figure 8:
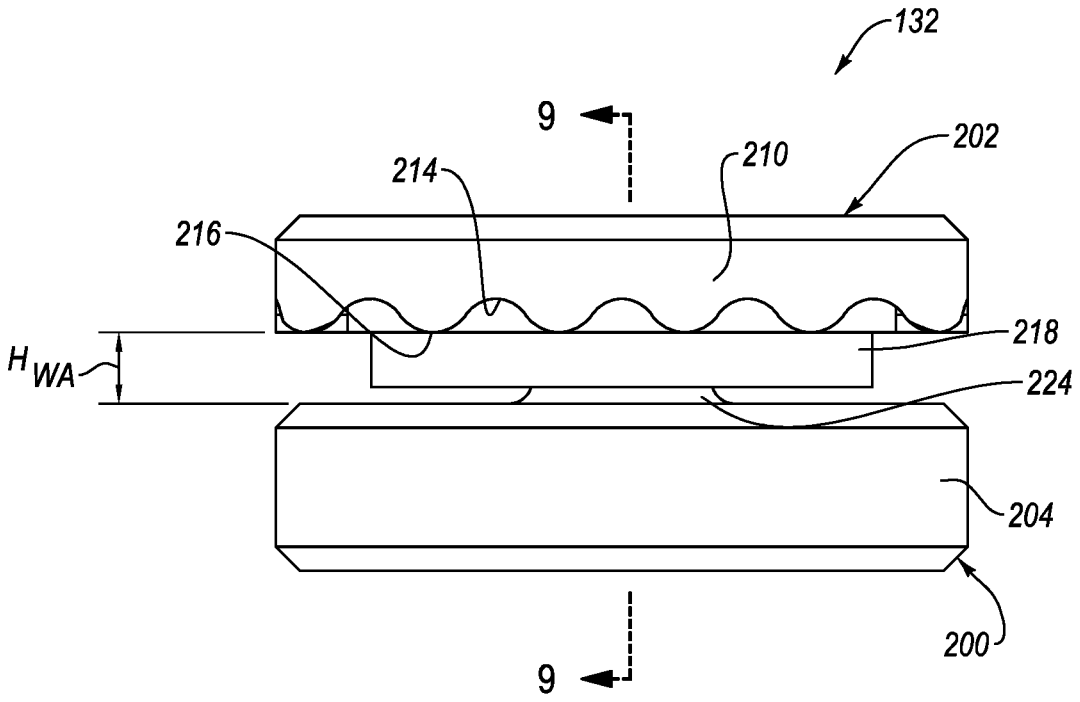
FIG. 8 is a side elevation view of the weight assembly of FIG. 5, according to one or more examples of the present disclosure.
Figure 9:
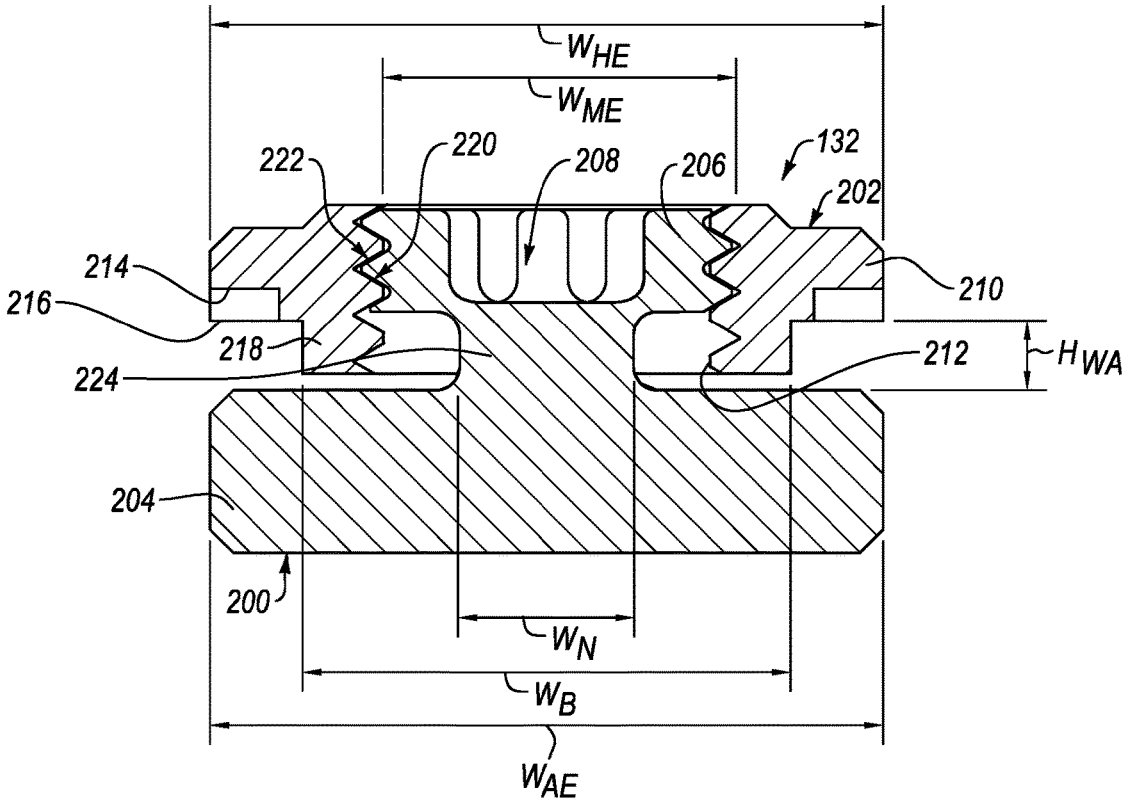
FIG. 9 is a cross-sectional side elevational side view of the weight assembly of FIG. 5, taken along the line 9-9 of FIG. 8, according to one or more examples of the present disclosure.

The golf club head 100 and many of its physical characteristics disclosed herein will be described using "normal address position" as the club head reference position, unless otherwise indicated. FIGS. 1-3 illustrate the golf club head 100 at normal address position. As used herein, "normal address position" means the position of the golf club head 100 when a vector normal to a center 123 of the strike face 131 lies in a first vertical plane (a vertical plane is perpendicular to a ground plane 180 or horizontal plane), the hosel axis 191 lies in a second vertical plane, and the first vertical plane and the second vertical plane perpendicularly intersect. For purposes of this description, the center 123 is also referred to as the "geometric center" of the strike face 131 (see also USGA "Procedure for Measuring the Flexibility of a Golf Clubhead," Revision 2.0, for a methodology to measure the geometric center of the strike face 131).

When at normal address position, the hosel axis 191 is disposed at a lie angle θ1 relative to the ground plane 180 (as shown in FIG. 1) and the strike face 131 has a loft angle θ2 (as shown in FIG. 3). The loft angle θ2 refers to the angle between a tangent line 127 tangent to the strike face 131, at the center 123, and a z-axis 165 normal to the ground plane 180 at normal address position.

As shown in FIGS. 1-3, in the normal address position the golf club head 100 is positioned such that the lie angle θ1 is approximately 60-degrees and the strike face 131 is square relative to an imaginary target line. Positioning the golf club head 100 in the reference position lends itself to using a club head origin coordinate system 185 for making various measurements. Additionally, the USGA methodology may be used to measure various parameters of the golf club head 100 described in this application, such as head height, head width, strike face height, strike face width, center of gravity (CG) location, and the like. Accordingly, reference to the measurement methods described in the '946 App and the USGA procedure is advised. Notably, however, the origin and axes used in this application may not necessarily be aligned or oriented in the same manner as those described in the '946 App or the USGA procedure. Further details are provided below on locating the club head origin coordinate system 185.

U.S. Patent Application Publication No. 2014/0302946 A1 ('946 App), published Oct. 9, 2014, which is incorporated herein by reference in its entirety, describes a reference position similar to the normal address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the golf club head 100 in the reference position.

Referring still to FIGS. 1-3, the club head origin coordinate system 185 is defined such that the location of various features of the club head (including a CG 187 of the golf club head 100) can be determined. The center 123 of the strike face 131 is defined as the origin of the golf club head 100 and thus the center of the origin coordinate system 185. The origin coordinate system 185 includes three axes: the z-axis 165 extending through the center 123 of the strike face 131 in a generally vertical direction relative to the ground plane 180 when the golf club head 100 is at the normal address position; an x-axis 170 extending through the center 123 of the strike face 131 in a toe-to-heel direction generally parallel to the strike face 131 (e.g., generally tangential to the strike face 131 at the center 123) and generally perpendicular to the z-axis 165; and a y-axis 175 extending through the center 123 of the strike face 131 in a front-to-back direction and generally perpendicular to the x-axis 170 and to the z-axis 165. The x-axis 170 and the y-axis 175 both extend in generally horizontal directions relative to the ground plane 180 when the golf club head 100 is at the normal address position. The x-axis 170 extends in a positive direction from the center 123 towards the heel region 116 of the golf club head 100. The y-axis 175 extends in a positive direction from the center 123 towards the rearward region 118 of the golf club head 100. The z-axis 165 extends in a positive direction from the center 123 towards the crown portion 119.

Generally, the CG 187 of the golf club head 100 is the point at which the entire weight of the golf club head 100 may be considered as concentrated so that if supported at this point the head would remain in equilibrium in any position. As shown in FIGS. 1-3, the CG 187 is shown as a point inside the body 110 of the golf club head 100. The location of the CG 187 can also be defined with reference to the club head origin coordinate system 185. For example, the location of the CG 187 along the x-axis 170, the y-axis 175, and the z-axis 165 can be defined as the CGx, CGy, and CGz of the CG 187. The position of other features of the golf club head 100 can similarly defined.

The golf club head 100 disclosed herein may have a volume equal to the volumetric displacement of the body 110. In other words, for a golf club head with one or more weight ports or other features formed into the body 110 and located within the head, it is assumed that the weight ports or other features are either not present or are "covered" by regular, imaginary surfaces, such that the club head volume is not affected by the presence or absence of ports or other such features. The golf club head 100 of the present application can be configured to have a head volume between about 110 $cm^3$ and about 600 $cm^3$ in some embodiments. In more particular embodiments, the head volume may be between about 250 $cm^3$ and about 500 $cm^3$. In yet more specific embodiments, the head volume may be between about 300 $cm^3$ and about 500 $cm^3$, between about 300 $cm^3$ and about 360 $cm^3$, between about 300 $cm^3$ and about 420 $cm^3$ or between about 420 $cm^3$ and about 500 $cm^3$.

In the case of a driver, the golf club head 100 may have a volume between about 300 $cm^3$ and about 460 $cm^3$, and a total mass between about 145 g and about 245 g. In the case of a fairway wood, the golf club head 100 may have a volume between about 100 $cm^3$ and about 250 $cm^3$, and a total mass between about 145 g and about 260 g. In the case of a utility or hybrid club, the golf club head 100 may have a volume between about 60 $cm^3$ and about 150 $cm^3$, and a total mass between about 145 g and about 280 g.

In some embodiments, such as shown in FIGS. 2 and 4-6, the body 110 of the golf club head 100 includes a frame 124 to which one or more inserts (e.g., crown insert 126, first sole insert 128, and second sole insert 129) of the body 110 are coupled. For example, the crown portion 119 of the body 110 includes the crown insert 126 coupled to a top side of the frame 124. Similarly, the sole portion 117 of the body 110 includes the first sole insert 128 and the second sole insert 129 coupled to a bottom side of the frame 124. Although the crown insert 126 is shown as a single piece, in other embodiments, the crown insert 126 may include two or more pieces.

The frame 124 of the golf club head 100 also includes a front weight track 136 (or toe-to-heel weight track), an intermediate weight track 130 (or front-to-rear weight track), and a rear weight track 136 located in the sole portion 117 of the body 110 of the golf club head 100. The front weight track 136, the intermediate weight track 130, and the rear weight track 136 each defines a track to which a weight assembly 132 is selectively slidably mounted. Details of the weight assembly 132 are described in more detail below with regards to FIGS. 5-12.

Figure 10:
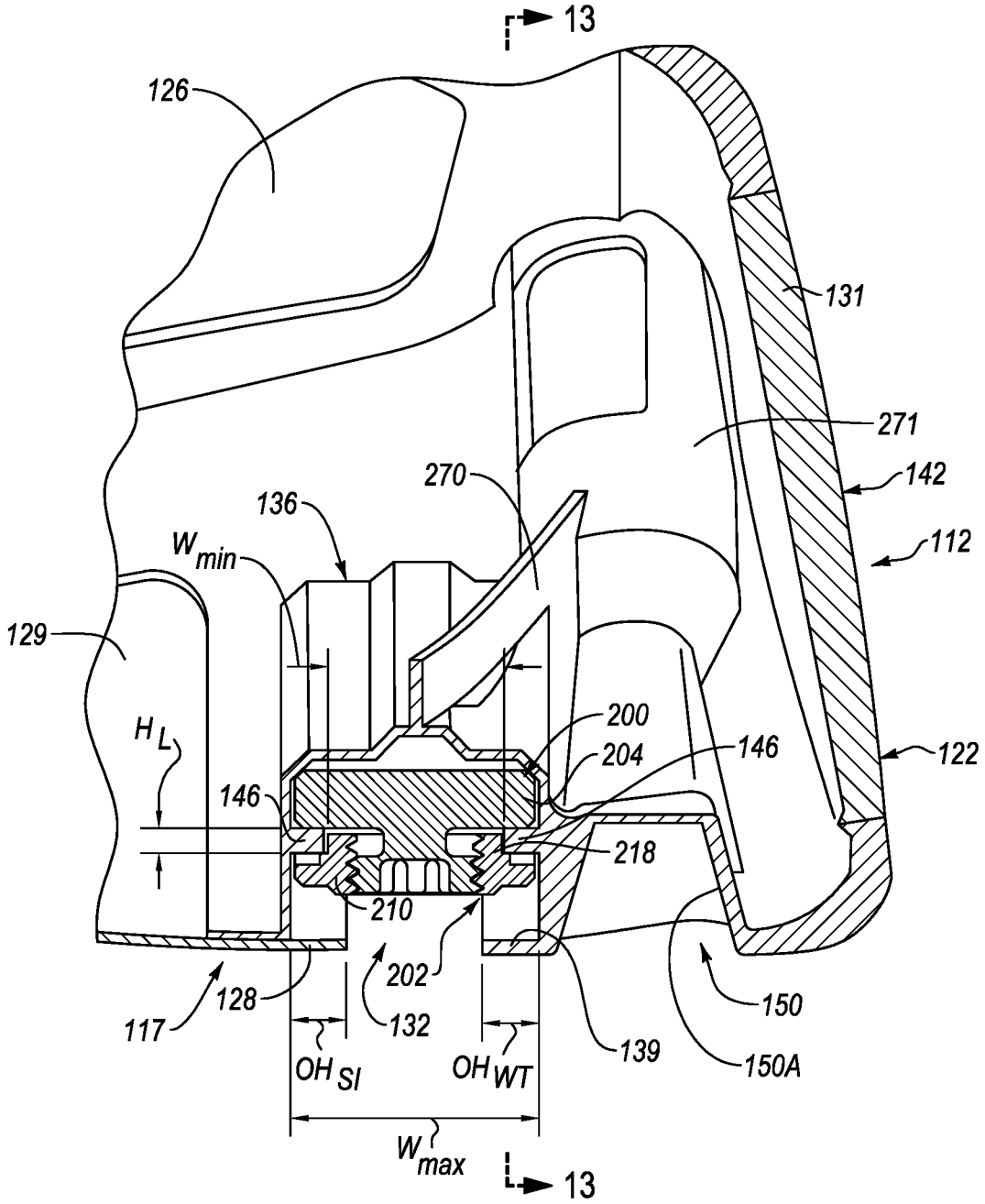
FIG. 10 is a cross-sectional side elevation view of a portion of the golf club head of FIG. 1, taken along the line 10-10 of FIG. 1, according to one or more examples of the present disclosure.

The front weight track 136 is integrally formed with the frame 124 at the forward region 112 and along the sole portion 117 of the body 110. The front weight track 136 extends generally parallel to, but offset from, the face portion 142 of the golf club head 100 and generally perpendicular to the intermediate weight track 130. The intermediate weight track 130. For example, the front weight track 136 defines a first weight assembly path 182 that is parallel to the x-axis 170 of the origin coordinate system 185. The front weight track 136 and the first weight assembly path 182 may be curved to follow a curvature of the sole portion 117. In some implementations, as shown in FIG. 10, the frame 124 includes an overhang 139 formed in the sole portion 117. The overhang 139 overhangs a forward portion of the front weight track 136 by a distance $OH_{WT}$. In some implementations, the distance $OH_{WT}$ is between about 5% and about 40% of the maximum width of the front weight track 136. According to one implementation, the distance $OH_{WT}$ is about 25% of the maximum width of the front weight track 136. An exterior surface of the overhang 139 forms an exterior (e.g., exterior-most) surface of the sole portion 117.

In some embodiments, the front weight track 136 is offset from the face portion 142 by an offset distance, which is the minimum distance between a first vertical plane passing through the center 123 of the strike face 131 and the front weight track 136 at the same x-axis coordinate as the center 123, between about 5 mm and about 50 mm, such as between about 5 mm and about 35 mm, such as between about 5 mm and about 30 mm, such as between about 5 mm and about 20 mm, or such as between about 5 mm and about 15 mm. The offset distance accommodates locating a channel 150, formed into the sole portion 117, between the face portion 142 and the front weight track 136. However, in some implementations, the golf club head 100 does not include the front weight track 136, such that the channel 150 is directly between the face portion 142 and the intermediate weight track 130. For example, the intermediate weight track 130 may terminate at the channel 150.

The channel 150 is a coefficient of restitution (COR) feature configured to improve and/or increase the COR across the strike face 131. The COR of the golf club head 10 is a measurement of the energy loss or retention between the golf club head 10 and a golf ball when the golf ball is struck by the golf club head 10. Desirably, the COR of the golf club head 10 is high to promote the efficient transfer of energy from the golf club head 10 to the ball during impact with the ball. Accordingly, the COR feature of the golf club head 10 promotes an increase in the COR of the golf club head 10. In some implementations, the channel 150 can be a closed channel or an open channel, such as a through-slot. As described above, the channel 150 acts as a COR feature to help increase the COR of the golf club head 10 by increasing or enhancing the perimeter flexibility of the strike face 131 of the golf club head 100. According to certain implementations, the COR feature may be located in the forward region 112 of the sole portion 117 of the body 110, adjacent to or near to a forwardmost edge of the sole portion 117.

The channel 150 may be a through-slot as discussed above and in U.S. patent application Ser. No. 13/839,727. Moreover, the channel 150 may have a width (W), length (L), and perimeter. In some embodiments, the width of the channel 150 may be between about 5 mm and about 20 mm, such as between about 10 mm and about 18 mm, such as between about 12 mm and about 16 mm, or it may be larger or smaller. The length of the channel 150 may be between about 30 mm and about 120 mm, such as between about 50 mm and about 100 mm, such as between about 60 mm and about 90 mm, or it may be larger or smaller. Additionally, or alternatively, the length of the channel 150 may be represented as a percentage of a length of the strike face 131. For example, the channel 150 may be between about 30% and about 100% of the striking face length, such as between about 50% and about 90%, or such as between about 60% and about 80% mm of the length of the strike face 131. The perimeter of the channel 150 may be between about 70 mm and about 280 mm, such as between about 120 mm and about 240 mm, such as between about 160 mm and about 200 mm, or it may be larger or smaller.

The channel 150 may be made up of curved sections, or several segments that may be a combination of curved and straight segments. Furthermore, the channel 150 may be machined or cast into the head. Although shown in the sole portion 117 of the golf club head 100, the channel 150 may be incorporated into the crown portion 119 of the golf club head 100.

The channel 150 or channel may be filled with a material to prevent dirt and other debris from entering the channel 150 and possibly the cavity of the golf club head 100 when the channel 150 is a through-slot. The filling material may be any relatively low modulus materials including polyurethane, elastomeric rubber, polymer, various rubbers, foams, and fillers. The filling material should not substantially prevent deformation of the golf club head 100 when in use as this would counteract the perimeter flexibility.

Further details concerning the channel 150 or the COR feature of the golf club head 100 can be found in U.S. patent application Ser. Nos. 13/338,197, 13/469,031, 13/828,675, filed Dec. 27, 2011, May 10, 2012, and Mar. 14, 2013, respectively, and incorporated herein by reference in their entirety. Additional details concerning a COR feature in the form of a slot, instead of a channel, can be found in U.S. patent application Ser. No. 13/839,727, filed Mar. 15, 2013, and incorporated herein by reference in its entirety. Yet further details concerning the COR feature of the golf club head 100 can be found in U.S. Pat. No. 8,235,844, filed Jun. 1, 2010, U.S. Pat. No. 8,241,143, filed Dec. 13, 2011, U.S. Pat. No. 8,241,144, filed Dec. 14, 2011, all of which are incorporated herein by reference.

The intermediate weight track 130 is integrally formed with the frame 124 along the sole portion 117 between the front weight track 136 and the rearward region 118. The intermediate weight track 130, and a second weight assembly path 184 defined by the intermediate weight track 130, defines an angle θ3 with the first weight assembly path 182. In one implementation, the angle θ3 is approximately 90-degrees. However, in other implementations, the angle θ2 is less than 90-degrees or more than 90-degrees, such as between 20-degrees and 90-degrees, between 40-degrees and 90-degrees, between 60-degrees and 90-degrees, between 70-degrees and 90-degrees, between 90-degrees and 160-degrees, between 90-degrees and 140-degrees, or between 90-degrees and 110-degrees. The particular angle of angle θ2 may depend on the geometry of the golf club head 100. In some embodiments, angling the intermediate weight track 130 relative to the front weight track 136 at an angle less than or more than 90-degrees may help reduce any draw or fade bias compared to an angle of 90-degrees especially when shifting the weight along the intermediate weight track 130.

The rear weight track 154 is integrally formed with the frame 124 along the sole portion 117 between the intermediate weight track 130 and the rearward region 118 (i.e., a rearward-most edge of the body 110. The rear weight track 154 extends away from the intermediate weight track 130 a direction from the front portion 142 towards the rearward region 118. In one embodiment, as shown, the rear weight track 154 includes two diverging branches. For example, the rear weight track 154 includes a first branch 154A and a second branch 154B. The first branch 154A extends away from the second weight assembly path 184 toward the toe region 114 and the second branch 154B extends away from the second weight assembly path 184 toward the heel region 116. The first branch 154A of the rear weight track 154, and a third weight assembly path 186A defined by the first branch 154A, defines an angle θ4 with the second weight assembly path 184. Similarly, the second branch 154B of the rear weight track 154, and a fourth weight assembly path 186B defined by the second branch 154B, defines an angle θ5 with the second weight assembly path 184.

In one implementation, each of the angle θ4 and the angle θ5 is between 0-degrees and approximately 180-degrees. In some implementations, the angle θ4 and/or the angle θ5 is less than 90-degrees, such as between 20-degrees and 60-degrees, between 30-degrees and 50-degrees, or about 45-degrees. Alternatively, the angle θ4 and/or the angle θ5 is more than 90-degrees, such as between 70-degrees and 150-degrees, between 80-degrees and 140-degrees, or about 135-degrees. The particular angle of angle θ4 and angle θ may depend on the geometry of the golf club head 100. In some embodiments, angling the first branch 154A and/or the second branch 154B of the rear weight track 154 may help reduce any draw or fade bias especially when shifting the weight along the rear weight track 154. The angle θ4 and the angle θ5 can be the same or different. Although the first branch 154A and the second branch 154B of the rear weight track 154 extend linearly away from the intermediate weight track 130 in the illustrated embodiment, in other embodiments, the first branch 154A and the second branch 154B may be curved. For example, intermediate weight track 130 may terminate at the rearmost portion of the sole portion 117 and the first branch 154A and the second branch 154B may curve to match a curvature of the rearmost portion of the sole portion 117. In fact, in some implementations, the first branch 154A and the second branch 154B may be curved so as to extend from the intermediate weight track 130 at least partially forwardly.

Each of the front weight track 136, the intermediate weight track 130, and the rear weight track 154 includes opposing rails or ledges 146, along a length of the weight tracks, that facilitate retention of the weight assembly 132 within the respective weight tracks. Generally, for each of the weight tracks, the weight assembly 132 clamps down on the opposing ledges 146 to releasably couple the weight assembly 132 to the weight track. The weight assembly 132 and the interaction with the ledges 146 is described in more detail below.

In some embodiments, the intermediate weight track 130 is contiguous with the front weight track 136, and the rear weight track 154 is contiguous with the front weight track 136, such that the weight assembly 132 can be continuously selectively slidable between the front weight track 136 and the intermediate weight track 130 and between the intermediate weight track 130 and the rear weight track 154 without removing the weight assembly 132 from any one weight track. In this manner, the intermediate weight track 130 can be considered an extension of the front weight track 136 and the rear weight track 154 can be considered an extension of the intermediate weight track 130. For example, the ledges 146 of the weight tracks may be seamlessly interconnected together. In one implementation, at least one ledge 146 of at least one of the weight tracks includes a notch 189 to help facilitate insertion of the weight assembly 132 into the weight tracks. The notch 189 effectively widens the gap (i.e., minimum track width Wmin (see, e.g., FIG. 10)) between opposing ledges 146 at a single discrete location along the weight tracks. Alternatively, or in addition, the weight track can have closed ends and a depth of at least one of the weight tracks can be increased in a useable portion of the weight track to facilitate insertion of the weight assembly 132 into the weight tracks. In yet another implementation, at least one of the weight tracks can have an open end through which the weight assembly 132 can be installed into the weight tracks.

As shown in FIG. 10, the front weight track 136, the intermediate weight track 130, and the rear weight track 154 have a certain maximum track width $W_{max}$ and a certain minimum track width $W_{min}$. Maximum track width $W_{max}$ is measured as the horizontal distance between a first channel wall and a second channel wall. For the front weight track 136, the intermediate weight track 130, and the rear weight track 154, the maximum track width may be between about 5 mm and about 20 mm, such as between about 10 mm and about 18 mm, or such as between about 12 mm and about 16 mm. Minimum track $W_{min}$ width is the horizontal distance between opposing ledges 146 of a given weight track. The minimum track width is less than the maximum track width. According to some embodiments, a depth of the weight tracks (i.e., the vertical distance between the bottom channel wall and an imaginary plane containing the regions of the sole portion 117 adjacent the front and rear edges of the channel) may be between about 6 mm and about 20 mm, such as between about 8 mm and about 18 mm, or such as between about 10 mm and about 16 mm.

Additionally, the front weight track 136, the intermediate weight track 130, and the rear weight track 154 each has a track length. Track length may be measured as the horizontal distance between end walls of the weight tracks. The track length of one of more of the front weight track 136, the intermediate weight track 130, and the rear weight track 154 can be between about 30 mm and about 120 mm, such as between about 50 mm and about 100 mm, or such as between about 60 mm and about 90 mm. Additionally, or alternatively, the length of the front weight track 136 may be represented as a percentage of the length of the strike face 131. For example, the front weight track 136 may be between about 30% and about 100% of the length of the strike face 131, such as between about 50% and about 90%, or such as between about 60% and about 80% mm of the length of the strike face 131.

Referring to FIGS. 5-9, according to one embodiment, the weight assembly 132 includes just two components. In other words, unlike some conventional weight assemblies for golf club heads that include three components (i.e., a three-piece weight assembly), the weight assembly 132 includes only two components (i.e., is a two-piece weight assembly). The weight assembly 132 is configured to be selectively adjustably secured to one of the weight tracks of the golf club head 100. Generally, the weight assembly 132 can be selectively loosened and allowed to slide along the weight tracks and selectively tightened, at a desired location along the weight tracks, to non-movably fix the weight assembly 132 to the weight tracks. The weight assembly 132 consists of an inner component 200 and an outer component 202. The inner component 200 is rotatably coupled to the outer component 202. For example, the inner component 200 and the outer component 202 are rotatable relative to each other in a first rotational direction to selectively loosen the weight assembly 132 in a weight track and rotatable relative to each other in a second rotational direction, opposite the first rotational direction, to selectively tighten the weight assembly 132 in a weight track. The inner component 200 is so-termed because, when coupled with a weight track, the inner component 200 is positioned interiorly of the outer component 202. In contrast, the outer component 202 is so-termed because, when coupled with a weight track, the outer component 200 is positioned exteriorly of the inner component 200.

The inner component 200 includes an anchor element 204, a mating element 206, and a neck 224. The neck 224 is interposed between and couples together the anchor element 204 and the mating element 206. In one implementation, the anchor element 204, the mating element 206, and the neck 224 are concentric. A maximum width $W_{AE}$ of the anchor element 204 is greater than a maximum width $W_{ME}$ of the mating element 206. Moreover, a maximum width $W_N$ of the neck 224 is less than the maximum width $W_{ME}$ of the mating element 206. The relatively narrow width of the neck 224 helps to place the weight assembly 132 in tension when tightened to the weight track and thus helps to keep the weight assembly 132 tight against the weight track during use of the golf club head 100.

In the illustrated embodiment, the anchor element 204 of the inner component 200 is a disc and the maximum width $W_{AE}$ of the anchor element 204 is a diameter of the disc. The anchor element 204, being circular shaped, promotes maneuverability within the weight tracks, can be manufactured via a lathing process, and optimizes volume and mass of the anchor element 204. However, in other embodiments, the anchor element 204, while being substantially flat and thin like a disc, has a non-round cross-sectional shape, such as a square shape where the maximum width $W_{AE}$ is a diagonal of the square. In some implementations, the anchor element 204 has beveled edges to facilitate smoother movement along the weight tracks.

According to the illustrated embodiment, the neck 224 of the inner component 200 is a cylinder with a substantially circular cross-sectional shape. However, in other implementations, the neck 224 may have a cross-sectional shape other than circular. The neck 224 spans between the anchor element 204 and the mating element 206 such that a gap is defined between the anchor element 204 and the mating element 206.

The mating element 206 of the inner component 200 is configured to rotatably mate with the outer component 202 and an adjustment tool (not shown) for rotating the inner component 200 relative to the outer component 202. To facilitate rotatable mating with the outer component 202, the mating element 206 includes external threads 222 in one implementation. However, in other embodiments, the mating element 206 may include other types of features that facilitate a frictional engagement between the inner component 200 and the outer component 202, such as a friction cam feature or a friction leaf spring feature. In one implementation, the mating element 206 includes a socket 208 configured to matingly receive an adjustment tool. The socket 208 can be any of various types of sockets, such as a Torx™ drive socket, a hex drive socket, a square drive socket, and the like, depending on the type of adjustment tool.

The outer component 202 of the weight assembly 132 includes a head element 210 and a boss 218. The boss 218 protrudes from an underside of the head element 210. Accordingly, when the inner component 200 is rotatably mated to the outer component 202, the boss 218 is interposed between, or positioned within a gap defined between, the head element 210 of the outer component 202 and the anchor element 204 of the inner component 200. Additionally, the outer component 202 includes an aperture 212 extending entirely through the head element 210 and the boss 218. The aperture 212 includes internal threads 220 configured to threadably engage the external threads 222 of the mating element 206. However, in other embodiments, aperture 212 may include other types of features that facilitate a frictional engagement between the inner component 200 and the outer component 202, such as a friction cam feature or a friction leaf spring feature.

In one implementation, the head element 210, the boss 218, and the aperture 212 are concentric. However, in other implementations, one or more of the head element 210 or the boss 218 can be non-concentric with the aperture 212. A maximum width $W_{HE}$ of the head element 210 is greater than a maximum width $W_B$ of the boss 218.

In the illustrated embodiment, the outer peripheral shape of the head element 210 of the outer component 202 is non-round. For example, as shown, the head element 210 can be square shaped such that the maximum width $W_{HE}$ of the head element 210 is a length of a side, or a diagonal, of the head element 210. In other examples, the head element 210 can be ovular, triangular, rectangular, or another non-circular shape. The head element 210, being non-circular shaped, helps prevent the outer component 202 from rotating within the weight tracks. More specifically, as shown in FIG. 10 for example, with the maximum width $W_{HE}$ of the head element 210 being equal to or greater than the maximum width $W_{max}$ of the weight tracks, the sidewalls of the weight tracks act as a stop to restrain rotation of the head element 210, and thus the outer component 202, relative to the weight tracks. For a square-shaped head element 210, the maximum width $W_{HE}$ is the diagonal dimension head element 210. However, as shown in the illustrated embodiment, the minimum width of the head element 210, or the length of a side of the head element 210, is equal to or just smaller than the maximum width $W_{max}$ of the weight tracks.

Figure 13:
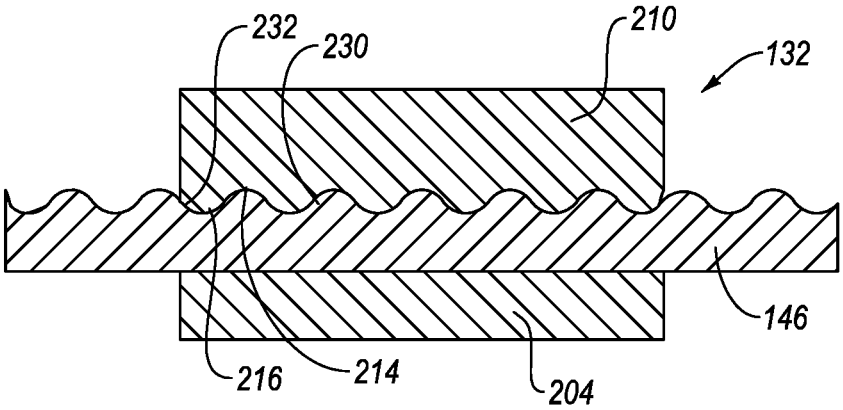
FIG. 13 is a schematic cross-sectional side elevation view of a weight assembly engaged with a ledge of a weight track, according to one or more examples of the present disclosure.

In some embodiments, the head element 210 may include track engagement features configured to matingly engage corresponding weight engagement features formed in the weight tracks. For example, the head element 210 in the illustrated implementation includes a plurality of tabs 216 and a plurality of recesses 214 or notches alternatingly formed into the underside of the head element 210 adjacent the outer periphery of the head element 210. Correspondingly, as shown in FIG. 13, an outwardly facing surface of each ledge 146 may include a plurality of tabs 230 and a plurality of recesses 232. Each recess 232 of the ledge 146 receives a respective one of the tabs 216 of the head element 210 and each tab 230 of the ledge 146 is received within a respective one of the recesses 214 of the head element 210. Engagement between corresponding recesses and tabs of the ledge 146 and the head element 210 can help promote non-movable fixation of the head element 210 within the weight tracks when the weight assembly 132 is clamped to the weight tracks. Additionally, the recesses and tabs of the ledge 146 and the head element 210 help promote proper and predictable positioning of the weight assembly 132 along the weight tracks by associating each of the recesses and/or tabs of the ledge 146 with indicia graphically identifying predetermined locations along the weight tracks. For example, the recesses and/or tabs in the ledges can serve as markers or indices to help locate the position of the weight assembly 132 along the weight tracks.

Although the track engagement features shown are formed into the head element 210 and the weight engagement features are formed into the outwardly facing surface of the ledges 146, in other embodiments, the track engagement features can be formed into an outward side of the anchor element 210 and the weight engagement features can be formed into the inwardly facing surface of the ledges 146. Furthermore, although the recesses and tabs are shown to be substantially semi-circular shaped, in other implementations, the recesses and tabs can have other shapes, such as triangular, rectangular, and the like.

The outer peripheral shape of the boss 218 may also have a non-circular shape. For example, as shown, the boss 218 can be square shaped such that the maximum width $W_B$ of the boss 218 is a length, or a diagonal, of a side of the boss 218. When the outer peripheral shape of the boss 218 is circular, the maximum width $W_B$ of the boss 218 is a diameter of the boss 218. The boss 218, being non-circular shaped, helps prevent the outer component 202 from rotating within the weight tracks. More specifically, as shown in FIG. 10 for example, with the maximum width $W_B$ of the boss 218 being equal to or greater than the gap between the ledges 146 of the weight tracks, the ledges 146 of the weight tracks act as stops to restrain rotation of the boss 218, and thus the outer component 202, relative to the weight tracks.

The anchor element 204, the mating element 206, and the neck 224 are co-formed as a one piece, unitary and seamless, one-piece construction. However, in some implementations, one or more of the anchor element 204, the mating element 206, and the neck 224 are separately formed and attached to each other, such as via a welding or bonding technique. Similarly, the head element 210 and the boss 218 of the outer component 202 can be co-formed as a one piece, unitary and seamless, one-piece construction. Alternatively, in some implementations, the head element 210 and the boss 218 are separately formed and attached to each other, such as via a welding or bonding technique. Each of the inner component 200 and outer component 202 can be made from any of various materials, such as metal (e.g., aluminum, tungsten, titanium, steel, associated alloys, etc.), plastic, composites, and the like. In one implementation, one or both of the inner component 200 and the outer component 202 is made from a high-density metal, such as tungsten. According to one implementation, the inner component 200 is made of a different material than the outer component 202. For example, the material of the outer component 202 can be denser or heavier than that of the inner component 200, or vice versa. The combined mass of the inner component 200 and the outer component 202 is between 3 grams and 32 grams in some implementations.

Figure 11:
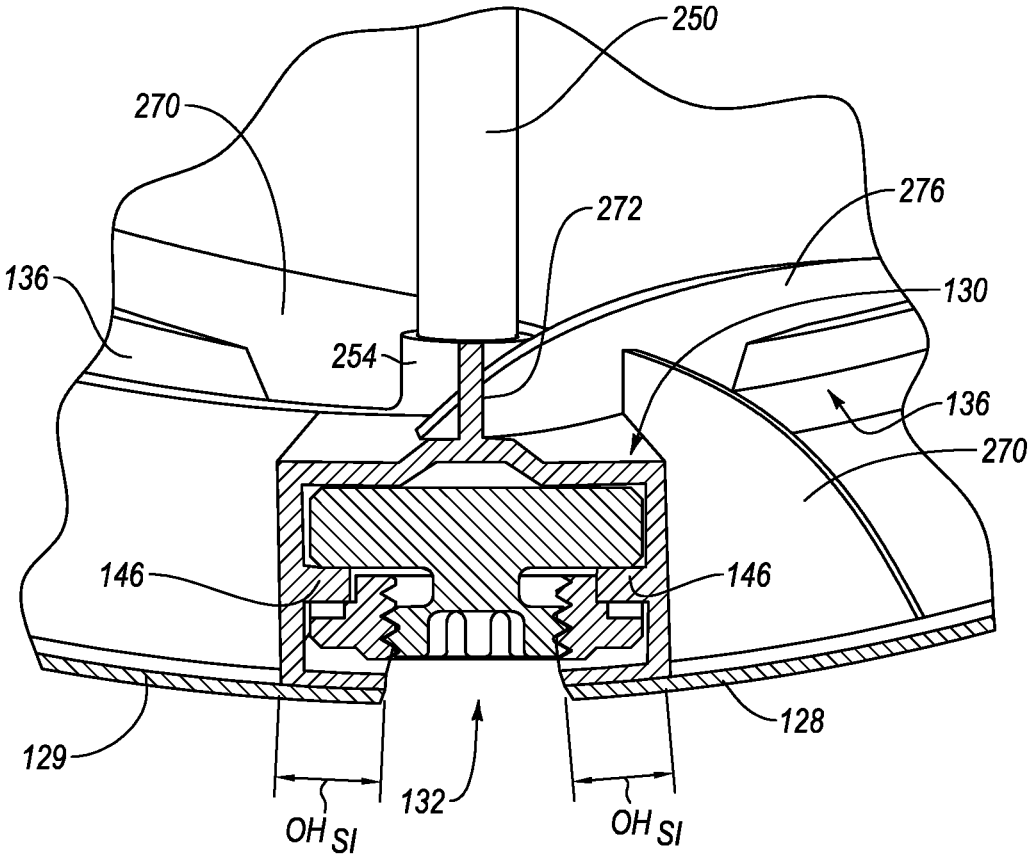
FIG. 11 is a cross-sectional front elevation view of a portion of the golf club head of FIG. 1, taken along the line 11-11 of FIG. 2, according to one or more examples of the present disclosure.
Figure 12:
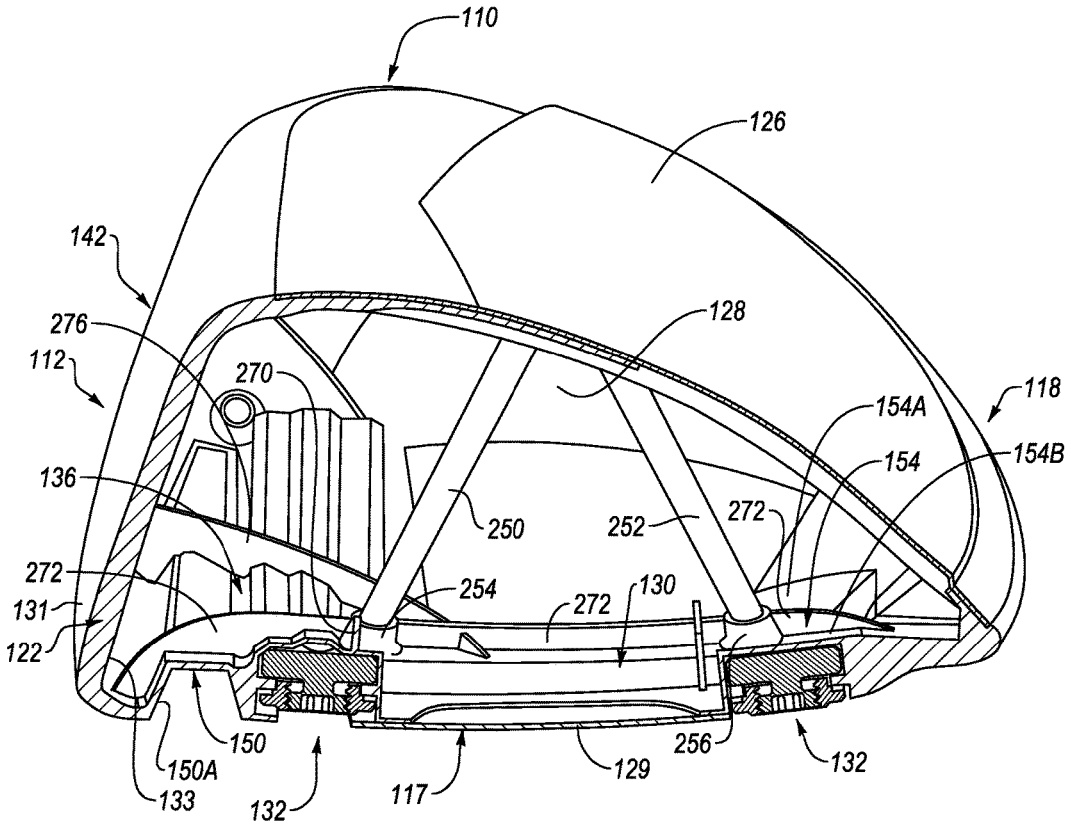
FIG. 12 is a cross-sectional side view of a portion of the golf club head of FIG. 1, taken along the line 12-12 of FIG. 1, according to one or more examples of the present disclosure.

Referring to FIGS. 10-12, weight assemblies 132 are shown installed in and non-movably fixed to the weight tracks of the golf club head 100. More specifically, a weight assembly 132 is installed and non-movably fixed in the front weight track 136 in FIG. 10, a weight assembly 132 is installed and non-movably fixed in the intermediate weight track 130 in FIG. 11, and respective weight assemblies 132 are installed and non-movably fixed in the front weight track 136 and the rear weight track 154, respectively, in FIG. 12. The weight assembly 132 is non-movably fixed in each of the weight tracks in the same manner. More specifically, with the anchor element 204 positioned within the weight track on one side of the ledges 146 of the weight track, the head element 210 positioned within the weight track on the opposite side of the ledges 146, and the mating element 206 of the inner component 200 threadably engaged with the head element 210 of the outer component 202, the outer component 202 can be rotated (such as with an adjustment tool) relative to the inner component 200 to draw the guide element 204 and the head element 210 together until the inner component 200 and the outer component 202 clamp down onto the ledges 146. The compressive force of the inner component 200 and the outer component 202 applied to the ledges 146 exceeds the external forces acting on the weight assembly 132 during use such that the weight assembly 132 stays in place during use. In some implementations, the square shape of the head element 210 increases the surface area in contact with the ledges 146, compared to a circular shape, and thus helps to improve the frictional engagement between the weight assembly 132 and the ledges 146.

In an alternative embodiment, the weight assembly 132 can be configured for installation into the weight track in a reversed manner. For example, although the anchor element 204 is shown installed on an interior side of the ledge 146 and the head element 210 is shown installed on an exterior side of the ledge 146, in one embodiment, the weight assembly 132 is flipped such that the head element 210 is installed on the interior side of the ledge 146 and the anchor element 204 is installed on the exterior side of the ledge 146. In such an embodiment, the socket 208 is formed in the anchor element 204 instead of, or in addition, to the head element 210.

The weight assembly 132 can be moved along a weight track into a different position by rotating (such as via an adjustment tool) the outer component 200 in an opposite rotational direction to urge the outer component 200 and the inner component 202 away from each other to effectively unclamp the ledges 146. With the weight assembly 132 unclamped from the ledges 146, the weight assembly 132 can be slid along the same weight track into a new position on the same weight track or moved into another weight track. Because the maximum width $W_{AE}$ of the anchor element 204 is greater than the gap or minimum width $W_{min}$ between the ledges 146, the anchor element 204 helps retain the weight assembly 132 within the weight track as the weight assembly 132 is slid along the weight track.

Adjustment of the positions of the weight assembly 132 or assemblies 132 along the weight tracks adjusts the performance characteristics of the golf club head 100. For example, the intermediate weight track 130 allows the weight assembly 132 to be selectively loosened and tightened for slidable adjustment forward and rearward along the intermediate weight track 130 to adjust the CG 187 of the golf club head 100 in a forward-to-rearward direction. By adjusting the CG 187 of the golf club head 100 forward or rearward, the performance characteristics of the golf club head 100 are adjusted, which promotes an adjustment to the flight characteristics of a golf ball struck by the golf club head 100, such as the spin characteristics of the golf ball. More specifically, moving the weight assembly 132 closer to the strike face 131 may produce a lower spinning ball due to a lower and more forward CG. This would also allow a user to increase club head loft, which in general higher lofted clubs are considered to be "easier" to hit. Moving the weight assembly 132 rearward towards the rear of the golf club head 100 allows for increased MOI and a higher spinning ball. Golf club heads with higher MOI are generally considered "easier" to hit. Accordingly, the intermediate weight track 130 allows for at least both spin and MOI adjustment.

Figure 14:
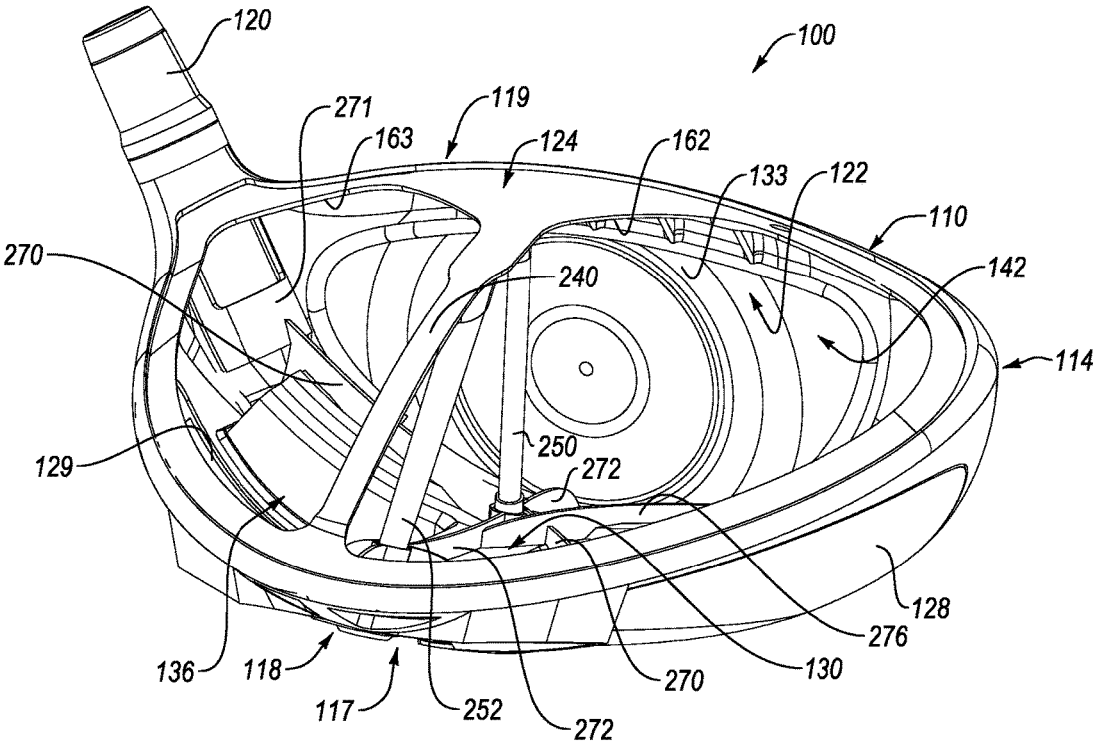
FIG. 14 is a perspective view of the golf club head of FIG. 1, shown with a crown insert removed, according to one or more examples of the present disclosure.

Each of the weight tracks may include more than one weight assembly 132. For example, as shown in FIG. 14, the intermediate weight track 130 includes two spaced-apart weight assemblies 132.

The front weight track 136 allows one or more weight assemblies 132 to be selectively loosened and tightened for slidable adjustment laterally, in the heel-to-toe direction, to adjust the effective CG 187 of the golf club head 100 in the heel-to-toe direction. By adjusting the CG 187 of the golf club head 100 laterally, the performance characteristics of the golf club head 100 are adjusted, which promotes an adjustment to the flight characteristics of a golf ball struck by the golf club head 100, such as the sidespin characteristics of the golf ball. Notably, the use of two weight assemblies 132 in the front weight track 136, which are independently adjustable relative to each other, allows for adjustment and interplay between the weight assemblies 132. For example, both weight assemblies 132 can be positioned fully in the toe region 114, fully in the heel region 116, spaced apart a maximum distance from each other, with one weight fully in the toe region 114, and the other weight fully in the heel region 116, positioned together in the center or intermediate location of the front weight track 136, or in other weight location patterns. Additionally or alternatively, multiple weight assemblies 132 may be secured to the rear weight track 154 such that there may be two or more weight assemblies 132 located in the rear weight track 154. In some implementations, the one or more weight assemblies 132 are adjustable within the weight tracks 130, 132, 154 to promote a range of adjustability of the CGy coordinate of the golf club head 100 of between 3 mm and 8 mm and a range of adjustability of the CGx coordinate of the golf club head 100 of between 2 mm and 8 mm, but a range of adjustability of the CGz coordinate of the golf club head 100 of no more than 2 mm, 1.5 mm, or 1.0 mm. The weight assemblies and weight tracks of the golf club head 100 as disclosed herein can achieve other CGx, CGy, and CGz ranges of adjustability, such as those disclosed in U.S. patent application Ser. No. 14/789,838, filed Jul. 1, 2015, which is incorporated herein in its entirety. For example, by moving one or more weights along the intermediate weight track the CGy of the golf club head may be adjusted by at least 3.5 mm, such as at least 4.0 mm, such as at least 4.5 mm, such as at least 5.0 mm, such as at least 5.5 mm, such as at least 6.0 mm, such as at least 6.5 mm, such as at least 7.0 mm, such as at least 7.5 mm.

Although the golf club head 100 includes at least one weight assembly 132 with a two-piece construction, in other embodiments, the golf club head 100 instead employs at least one assembly with at least a three-piece construction or a single-piece construction.

Figure 15:
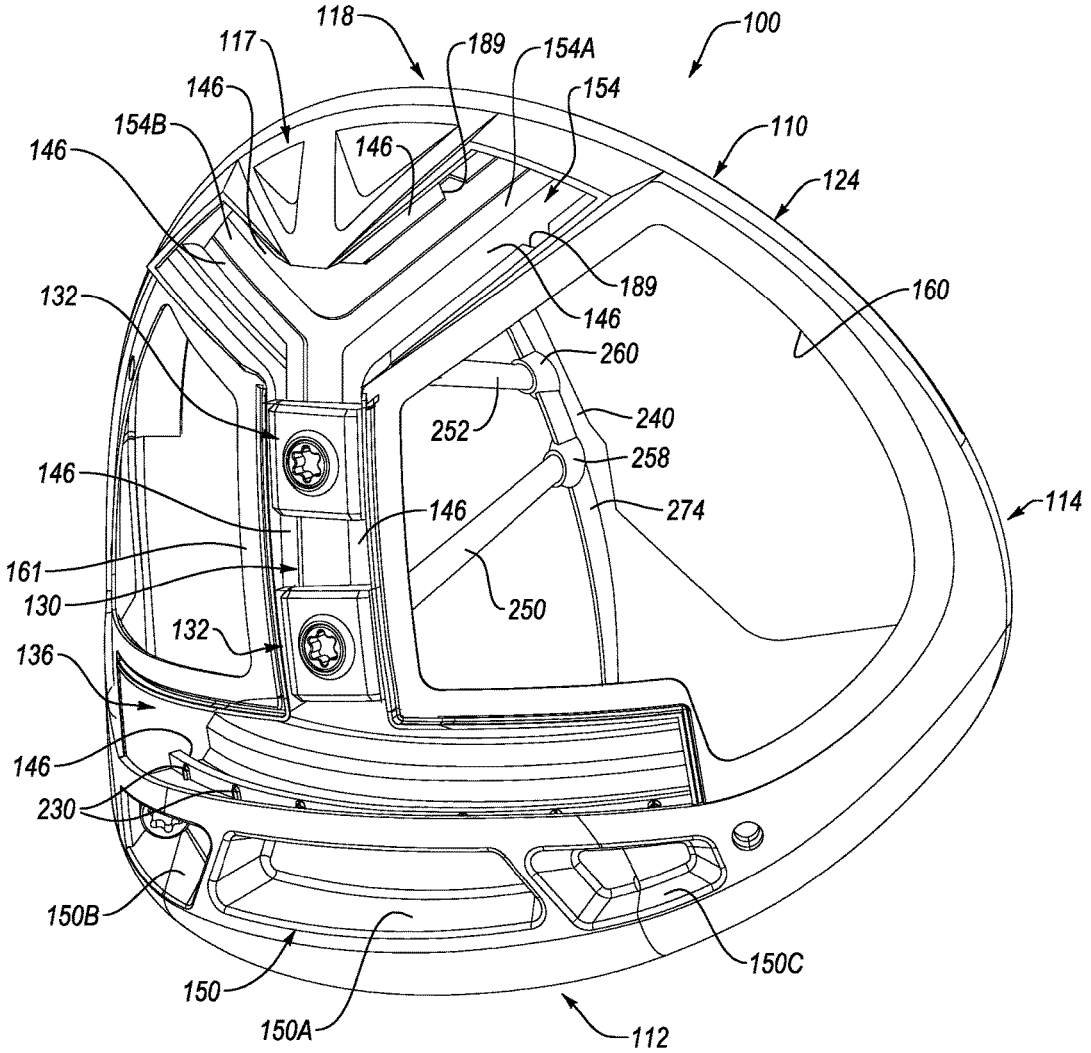
FIG. 15 is a perspective view of the golf club head of FIG. 1, shown with sole inserts removed, according to one or more examples of the present disclosure.

Although in some examples of the golf club head 100, the body 110 does not include inserts (e.g., the entirety of the body 110 forms a one-piece monolithic construction), according to certain examples of the golf club head 100, the body 110 includes one or more inserts fixedly secured to the frame 124. The frame 124 of the body 110 may have at least one sole opening and/or at least one crown opening. For example, referring to FIGS. 14 and 15, the frame 124 includes a first sole opening 160, a second sole opening 161, a first crown opening 162, and a second crown opening 163. The first sole opening 160 is sized and configured to fixedly receive the first sole insert 128. The second sole opening 161 is sized and configured to fixedly receive the second sole insert 129. The first crown opening 162 and the second crown opening 163 are sized and configured to collectively fixedly receive the crown insert 126. The frame 124 includes respective edges or seats extending about the periphery of and defining the first sole opening 160, the second sole opening 161, the first crown opening 162, and the second crown opening 163. In other words, the frame 124 includes a seated region adjacent each of the first sole opening 160, the second sole opening 161, the first crown opening 162, and the second crown opening 163. Each insert is received within and adhered directly to the seated region corresponding with the opening covered by the insert. In some implementations, the seated regions allow the inserts to be seated flush with the frame 124 to provide a smooth seamless outer surface or, alternatively, slightly recessed outer surface.

Referring to FIGS. 10-12, the first sole insert 128 and the second sole insert 129 may be sized to partially overhang the intermediate weight track 130 and/or the front weight track 136. As shown in FIG. 10, each of the first sole insert 128 and the second sole insert 129 overhangs a rearward portion of the front weight track 136 a distance $OH_{SI}$. In some implementations, the distance $OH_{SI}$ overhanging the front weight track 136 is between about 5% and about 40% of the width of the front weight track 136. According to one implementation, the distance $OH_{SI}$ overhanging the front weight track 136 is about 25% of the width of the front weight track 136. As shown in FIG. 11, each of the first sole insert 128 and the second sole insert 129 also overhangs a portion of the intermediate weight track 130 a distance $OH_{SI}$. In some implementations, the distance $OH_{SI}$ overhanging the intermediate weight track 130 is between about 5% and about 40% of the width of the intermediate weight track 130. According to one implementation, the distance $OH_{SI}$ overhanging the intermediate weight track 130 is about 25% of the width of the intermediate weight track 130. With the distance $OH_{SI}$ less than half of the width of the weight tracks, the weight assemblies 132 installed within the weight tracks are still accessible for adjusting the position of the weight assemblies 132. Overhanging the front weight track 136 and the intermediate weight track 130 with the overhang 139 of the frame 124, the first sole insert 128, and the second sole insert 129 helps improve the visual appearance and/or the aerodynamics of the golf club head 100. Although the first sole insert 128 and the second sole insert 129 are shown to not overhang the rear weight track 154, in some implementations, the first sole insert 128 and the second sole insert 129 are sized to partially overlap the second branch 154B and the first branch 154A, respectively, of the rear weight track 154 in a manner similar to that described above. In some implementations, the first sole insert 128 and/or the second sole insert 129 are sized such the distance $OH_{SI}$ is zero or such that there is no overhang over the weight tracks. According to one example, the first sole insert 128 may have no overhang, but the second sole insert 129 may have some overhang.

The first crown opening 162 and the second crown opening 163 are partially defined by a spine portion 240 of the frame 124. The spine portion 240 is a narrow and elongated thin-walled portion of the frame 124 that extends, in a substantially front-to-back direction, across the crown portion of the body 110 from the face portion 142 to the rearward region 118. The spine portion 240 effectively divides the first crown opening 162 from the second crown opening 163. Moreover, the spine portion 240 partially defines the seated regions of the frame 124. The crown insert 126 is supported on and adhered to the spine portion 240. In this manner, the spine portion 240 helps to strengthen the frame 124, improve the rigidity of the frame 124, and promote attachment of the crown insert 126 to the frame 124. The spine portion 240 is parallel to the y-axis 175 of the club head origin coordinate system 185 in some implementations. However, in other implementations, the spine portion 240 is non-parallel relative to the y-axis. For example, the spine portion 240 may include two narrow and elongated thin-walled portions that are angled relative to the y-axis 175 and diverge away from each other in a front-to-rear direction. In such an example, the two thin-walled portions define three separate crown openings in the frame 124.

Though not shown, the frame 124 may have a face opening, at a forward region 112 of the body 110, to receive and fixedly secure the strike face of the golf club head 100. The strike face can be fixedly secured to the face opening of the frame 124 by welding, braising, soldering, screws, or other coupling means. The strike face can be made from any of various materials, such as, for example, metals, metal alloys, fiber-reinforced polymers, and the like. Alternatively, in some implementations, the face portion 142 may be integrally formed with the frame 124.

The frame 124 of the body 110 may be made from a variety of different types of materials. According to one example, the frame 124 may be made from a metal material, such as a titanium or titanium alloy (including but not limited to 9-1-1 titanium, 6-4 titanium, 3-2.5, 6-4, SP700, 15-3-3-3, 10-2-3, or other alpha/near alpha, alpha-beta, and beta/near beta titanium alloys), aluminum and aluminum alloys (including but not limited to 3000 series alloys, 5000 series alloys, 6000 series alloys, such as 6061-T6, and 7000 series alloys, such as 7075), or the like. The frame 124 may be formed by conventional casting, metal stamping, or other known manufacturing processes. In certain examples, the frame 124 may be made of non-metal materials. Generally, the frame 124 provides a framework or skeleton of the golf club head 100 to strengthen the golf club head 100 in areas of high stress caused by the impact of a golf ball with the face portion 142. Such areas include a transition region where the golf club head 100 transitions from the face portion 142 to the crown portion 119, the sole portion 117, and the skirt portion 121 of the body 111.

In one embodiment, each of the first sole insert 128, the second sole insert 129, and/or the crown insert 126 (collectively "the inserts") may be made from a polymer or fiber-reinforced polymer (e.g., composite material). The polymer can be any of various polymers, such as thermoplastic or thermoset materials. The fibers of the fiber-reinforced polymer or composite material can be any of various fibers, such as carbon fiber or glass fiber. One exemplary material from which the inserts may be made from is a thermoplastic continuous carbon fiber composite laminate material having long, aligned carbon fibers in a PPS (polyphenylene sulfide) matrix or base.

The composite material of the sole and crown inserts may have any of some possible layups as shown in the table below. The 0-degree direction is front-to-back and 90-degree direction is heel-to-toe. The first ply is inside and the last ply is outside. By making the crown, sole, and/or face out of a less dense material, it may provide cost savings or it may allow for weight to be redistributed from the crown, sole, and/or face to other areas of the club head, such as, for example, low and/or forward. U.S. Pat. No. 8,163,119 discloses composite articles and methods for making composite articles, which is incorporated by reference herein in the entirety. This patent discloses the usual number of layers for a striking plate is substantial, e.g., fifty or more. However, improvements have been made in the art such that the layers may be decreased to between 30 and 50 layers. As already discussed for a sole and/or crown the layers can be substantially decreased down to three, four, five, six, seven, or more layers. These layups show possible crown and/or sole construction using unidirectional plies unless noted as woven plies. The construction shown is for a quasi-isotropic layup. A single layer ply has a thickness of ranging from about 0.065 mm to about 0.080 mm for a standard FAW of 70 gsm with about 36% to about 40% resin content. The thickness of each individual ply may be altered by adjusting either the FAW or the resin content, and therefore the thickness of the entire layup may be altered by adjusting these parameters.

| ply 1 | ply 2 | ply 3 | ply 4 | ply 5 | ply 6 | ply 7 | ply 8 | AW g/m$^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| 0 | 90 | +45 | −45 | 0/90 woven | | | | 490-720 |
| 0 | 90 | +45 | −45 | +45 | 0/90 woven | | | 490-720 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0/90 woven | 780-960 |
| 90 | 0 | 45 | −45 | 0 | −45 | 45 | 90/0 woven | 780-960 |

Referring to the above table, one embodiment of the composite inserts having a 0/90/45/−45/(0/90 woven) layup has a mass of about 8.2 g and a final thickness of 0.58 mm. Another embodiment of the composite inserts having a 0/90/45/−45/45/(0/90 woven) has a mass of 9.3 g and/or a final thickness of 0.65 mm or 0.58 mm.

The Area Weight (AW) is calculated by multiplying the density times the thickness. For the plies shown above made from composite material the density is about 1.5 g/cm$^3$ and for titanium the density is about 4.5 g/cm$^3$. Depending on the material used and the number of plies the composite crown and/or sole thickness ranges from about 0.195 mm to about 0.9 mm, preferably from about 0.25 mm to about 0.75 mm, more preferably from about 0.3 mm to about 0.65 mm, even more preferably from about 0.36 mm to about 0.56 mm. It should be understood that although these ranges are given for both the crown and sole together it does not necessarily mean the crown and sole will have the same thickness or be made from the same materials. In certain embodiments, the sole may be made from either a titanium alloy or a steel alloy. Similarly the main body of the club may be made from either a titanium alloy or a steel alloy. The titanium will typically range from 0.4 mm to about 0.9 mm, preferably from 0.4 mm to about 0.8 mm, more preferably from 0.4 mm to about 0.7 mm, even more preferably from 0.45 mm to about 0.6 mm. In some instances, the crown and/or sole may have non-uniform thickness, such as, for example varying the thickness between about 0.45 mm and about 0.55 mm.

A commercial example of a fiber-reinforced polymer from which the inserts may be made is TEPEX® DYNALITE 207 manufactured by Lanxess®. TEPEX® DYNALITE 207 is a high strength, lightweight material, arranged in sheets, having multiple layers of continuous carbon fiber reinforcement in a PPS thermoplastic matrix or polymer to embed the fibers. The material may have a 54% fiber volume, but can have other fiber volumes (such as a volume of 42% to 57%). According to one example, the material weighs 200 g/m$^2$.

Another commercial example of a fiber-reinforced polymer from which the inserts is made is TEPEX® DYNALITE 208. This material also has a carbon fiber volume range of 42 to 57%, including a 45% volume in one example, and a weight of 200 g/m2. DYNALITE 208 differs from DYNALITE 207 in that it has a TPU (thermoplastic polyurethane) matrix or base rather than a polyphenylene sulfide (PPS) matrix.

By way of example, the fibers of each sheet of TEPEX® DYNALITE 207 sheet (or other fiber-reinforced polymer material, such as DYNALITE 208) are oriented in the same direction with the sheets being oriented in different directions relative to each other, and the sheets are placed in a two-piece (male/female) matched die, heated past the melt temperature, and formed to shape when the die is closed. This process may be referred to as thermoforming and is especially well-suited for forming the inserts. After the inserts are formed (separately, in some implementations) by the thermoforming process, each is cooled and removed from the matched die. In some implementations, the inserts are shown as having a uniform thickness, which facilitates use of the thermoforming process and ease of manufacture. However, in other implementations the one or more of the inserts may have a variable thickness to strengthen select local areas of the insert by, for example, adding additional plies in select areas to enhance durability, acoustic properties, or other properties of the respective inserts.

In some embodiments, each of the inserts has a complex three-dimensional shape and curvature corresponding generally to a desired shape and curvature of the crown portion 119 and the sole portion 117 of the golf club head 100. It will be appreciated that other types of club heads, such as fairway wood-type clubs, may be manufactured using one or more of the principles, methods, and materials described herein.

In an alternative embodiment, one or more of the inserts can be made by a process other than thermoforming, such as injection molding or thermosetting. In a thermoset process, the inserts may be made from "prepreg" plies of woven or unidirectional composite fiber fabric (such as carbon fiber composite fabric) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the inserts. Each insert is cooled and removed from its respective mold.

The carbon fiber reinforcement material for the inserts, made by the thermoset manufacturing process, may be a carbon fiber known as "34-700" fiber, available from Grafil, Inc., of Sacramento, Calif., which has a tensile modulus of 234 Gpa (34 Msi) and a tensile strength of 4500 Mpa (650 Ksi). Another suitable fiber, also available from Grafil, Inc., is a carbon fiber known as "TR50S" fiber which has a tensile modulus of 240 Gpa (35 Msi) and a tensile strength of 4900 Mpa (710 Ksi). Exemplary epoxy resins for the prepreg plies used to form the thermoset crown and sole inserts include Newport 301 and 350 and are available from Newport Adhesives & Composites, Inc., of Irvine, Calif.

In one example, the prepreg sheets have a quasi-isotropic fiber reinforcement of 34-700 fiber having an areal weight between about 20 g/m^2 to about 200 g/m^2 preferably about 70 g/m^2 and impregnated with an epoxy resin (e.g., Newport 301), resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

After the inserts are formed, they are joined to the frame 124 in a manner that creates a strong integrated construction adapted to withstand normal stress, loading, and wear and tear expected of commercial golf clubs. For example, each of the inserts may be bonded to the frame 124 using epoxy adhesive, with the crown insert 126 seated in and overlying the first crown opening 162 and the second crown opening 163 and the first sole insert 128 and the second sole insert 129 seated in and overlying the first sole opening 160 and the second sole opening 161, respectively. Alternative attachment methods include bolts, rivets, snap fit, adhesives, and other known joining methods or any combination thereof may be used to couple the inserts with the frame 124.

In alternative embodiments, the first sole insert 128 and the second sole insert 129 of the golf club head 100 are not made from a fiber-reinforced polymer. Rather, in one implementation, the first sole insert 128 and the second sole insert 129 are made from a metal or metal alloy, such as titanium, and in another implementation, the sole portion 117 includes a one-piece monolithic construction, made from a metal or metal alloy, such as titanium, instead of separately attachable sole inserts. Accordingly, in at least one embodiment, the crown portion 119 of the golf club head 100 may be made from a first material, such as a fiber-reinforced polymer, and the sole portion 117 may be made from a metal or metal alloy, such as titanium. Moreover, in such an embodiment, more than between about 60% and 80% (e.g., about 70%) of the crown portion 119 of the body 110 of the golf club head 100 has a thickness less than about 0.75 mm.

Moreover, in some embodiments, the crown insert 126 of the crown portion 119 of the golf club head 100 is not made from a fiber-reinforced polymer. Rather, in one implementation, the crown insert 126 of the crown portion 119 is made from a metal or metal alloy, such as titanium, and in another implementation, the crown portion 119 includes a one-piece monolithic construction, made from a metal or metal alloy, such as titanium, instead of a separately attachable crown insert. Accordingly, in at least one embodiment, an entirety of the golf club head 100 may be made from a metal or metal alloy, such as titanium. Moreover, in such an embodiment, more than between about 60% and 80% (e.g., about 70%) of the crown portion 119 of the body 110 of the golf club head 100 has a thickness less than about 0.75 mm.

Based on the foregoing, the body 110 of the golf club head 100 of the present disclosure can have at least one of a crown portion 119 at least partially made from a fiber-reinforced polymer, a sole portion 117 at least partially made from a fiber-reinforced polymer, or a crown portion 119 and a sole portion 117 made entirely from a metal or metal alloy.

Referring to FIGS. 10, 11, 12, 14, and 15, views of various portions of the hollow interior of the body 110 golf club head 100 are shown. In the illustrated embodiments, the golf club head 100 includes various features located within the hollow interior of the body 110 to promote various characteristics of the golf club head 100. For example, several internal ribs and brace bars are coupled to the body 110 within the hollow interior to provide structural support and additional rigidity for the golf club head 10. The internal ribs and/or brace bars may also modify and even fine tune the acoustic properties of the golf club head 100. The sound and modal frequencies emitted by the golf club head 100 when striking a golf ball can be important to the sensory experience of the golfer and provide functional feedback as to where on the strike face 131 the impact with the golf ball occurs (and whether the golf ball is well struck).

As shown in FIGS. 11, 12, 14, and 15, the golf club head 100 includes a forward brace bar 250 and a rearward brace bar 252 coupled to the body 110 within the hollow interior of the body 110. The forward brace bar 250 and a rearward brace bar 252 extend from the weight tracks to the spine portion 240. Each of the forward brace bar 250 and the rearward brace bar 252 is an elongated hollow or solid tubular member having any of various cross-sectional shapes, such as circular (see, e.g., FIG. 16H). However, a brace bar can be more generally defined as a structure having any of various shapes and sizes projecting or extending from any portion of the golf club head 100 to provide structural support to, improved performance of, and/or acoustical enhancement of the golf club head 100.

According to some implementations, as shown in FIGS. 14 and 16A-16I, each of the forward brace bar 250 and the rearward brace bar 252 has a length $L_{BB}$ and a width $W_{BB}$ transverse to the length $L_{BB}$. The length $L_{BB}$ of a brace bar is the maximum distance between a bottom end of the brace bar and a top end of the brace bar. The width $W_{BB}$ of a brace bar is the minimum distance from a given point on one elongated side of the brace bar to the opposite elongated side of the brace bar in a direction substantially parallel with the x-axis 170 (e.g., heel-to-toe direction). For a circular bridge bar, the width $W_{BB}$ is a diameter of the bridge bar. The width $W_{BB}$ of a brace bar is significantly less than the length $L_{BB}$ of the brace bar. The width $W_{BB}$ of one or both of the forward brace bar 250 and the rearward brace bar 252 can be greater at the bottom end than at the top end to promote a lower Z-up. Alternatively, the width $W_{BB}$ of one or both of the forward brace bar 250 and the rearward brace bar 252 can be greater at the top end than at the bottom end to promote a higher Z-up. In yet some implementations, the width $W_{BB}$ of one or more of the forward brace bar 250 and the rearward brace bar 252 is constant from the top end to the bottom end.

According to some implementations, the width $W_{BB}$ of one or both of the forward brace bar 250 and the rearward brace bar 252 at a bottom end and at a top end is between 1 mm and 5 mm, such as 2 mm. In some implementations, the length $L_{BB}$ of the bridge bar 140 is between 50 mm and 60 mm, such as about 53 mm.

Referring to FIGS. 16A-16I, the forward brace bar 250 and the rearward brace bar 252 each has a depth $D_{BB}$ less than the length $L_{BB}$ of the corresponding brace bar. The depth $D_{BB}$ of the forward brace bar 250 and the rearward brace bar 252 is the minimum distance from a given point on a rearward side of the corresponding brace bar to a forward side of the corresponding brace bar in a direction substantially parallel with the y-axis 175 (e.g., front-to-rear direction). In certain implementations, the depth $D_{BB}$ of a brace bar is between 1 mm and 5 mm, such as 2 mm. The depth $D_{BB}$ of one or both of the forward brace bar 250 and the rearward brace bar 252 can be greater at a bottom end than at a top end.

Additionally, in some implementations, each of the forward brace bar 250 and the rearward brace bar 252 includes one or more webs 143 or flanges 141 (e.g., arms). For example, referring to FIG. 10A, one or both of the forward brace bar 250 and the rearward brace bar 252 includes a flange 141 and a web 143, perpendicular to the flange 141, to form a T-shape and one or both of the forward brace bar 250 and the rearward brace bar 252 in FIG. 16E includes two flanges 141 and one web 143, perpendicular to the flanges 141, to form an I-shape. Each flange 141 and each web 143 of the brace bar has a corresponding thickness T less than the width $W_{BB}$ and depth $D_{BB}$ of the bridge bar. In some implementations, the thickness T is between 0.5 mm and 5.0 mm, between 0.7 mm and 3.0 mm, between 1.0 mm and 2.0 mm, or between 1.2 mm and 1.75 mm. In one implementation, the thickness T is about 1.5 mm.

Figures 16A, 16B, 16C, 16D, 16E, 16F, 16G, 16H, 16I:
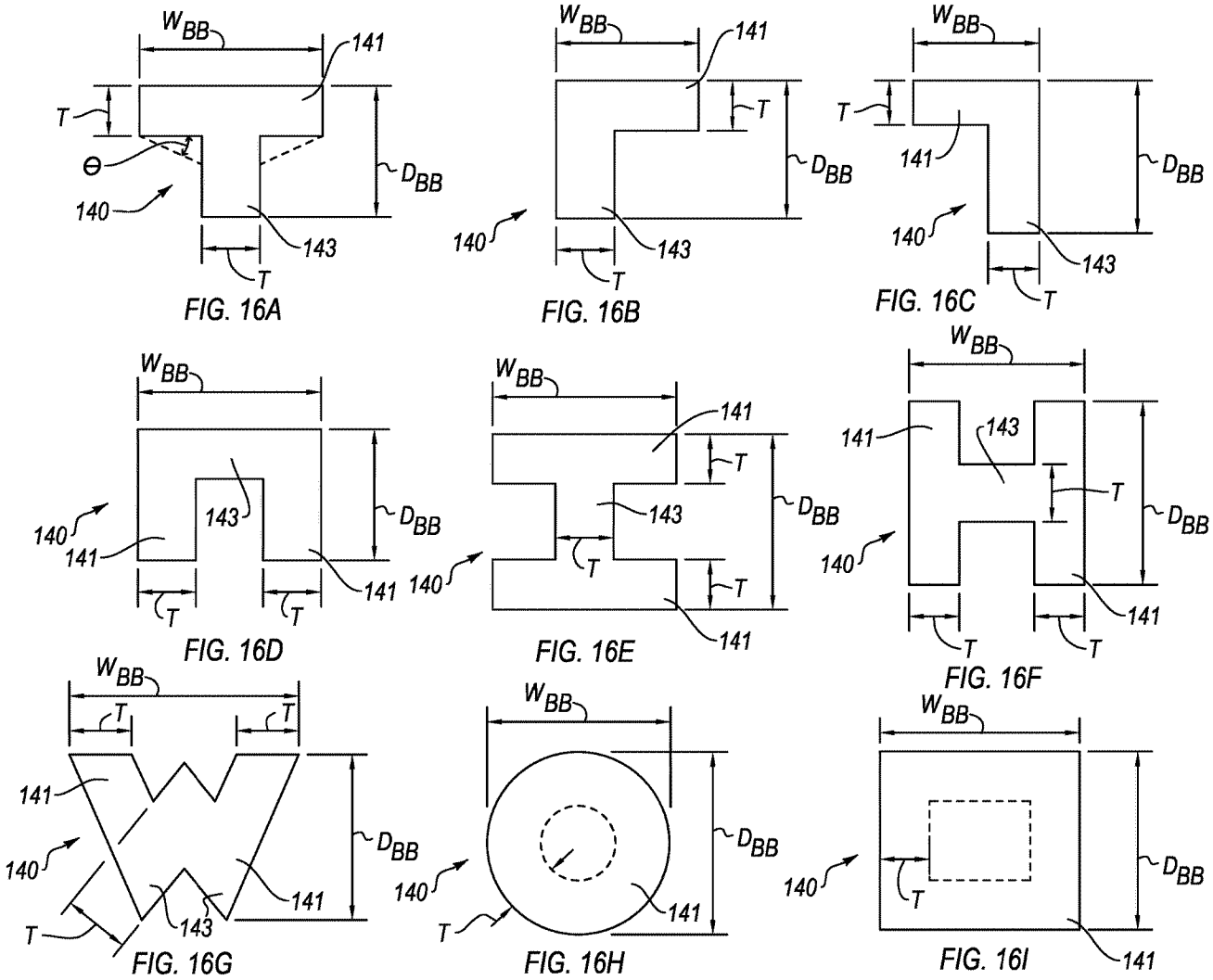
FIGS. 16A-16I are cross-sectional views of a brace bar of a golf club head, taken along a line analogous to the line 16-16 of FIG. 14, according to one or more examples of the present disclosure.

The forward brace bar 250 and the rearward brace bar 252 can have a cross-section, taken along the line 16-16 of FIG. 14, which is parallel to the x-y plane, that has any of various shapes. Referring to FIG. 16A, in one embodiment, the brace bar has a substantially T-shaped cross-section. More specifically, the brace bar includes a flange 141, substantially parallel with the X-axis 170, and a web 143, substantially parallel with the Y-axis 175. The flange 141 is co-formed with the web 143. The flange 141 can be forward of the web 143 when installed within the golf club head. However, in other implementations, the brace bar can be oriented differently, such as, for example, rotated 180-degrees relative to that shown so that the flange 141 is rearward of the web 143.

The forward brace bar 250 and the rearward brace bar 252 can have a cross-sectional shape different than a T-shape (e.g., FIG. 16A), such as an L-shape (e.g., FIGS. 16B and 16C), U-shape (e.g., FIG. 16D), I-shaped (e.g., FIG. 16E), H-shape (e.g., FIG. 16F), W-shape (e.g., FIG. 16G), circular-shape (e.g., FIG. 16H), square-shape or rectangular-shape (e.g., FIG. 16I), and the like. Also, the cross-sectional shape and/or size of the forward brace bar 250 and the rearward brace bar 252 may change over the length of the brace bar. For example, while the cross-sectional shape of the forward brace bar 250 and the rearward brace bar 252 is constant over the length of the brace bar, the cross-sectional size of the brace bar may decrease from the sole portion 117 toward the crown portion 119. The forward brace bar 250 and the rearward brace bar 252 can be constructed to be solid or hollow. For example, the circular and square shaped brace bars of FIGS. 16H and 16I can be solid or optionally have a hollow interior channel as shown in dashed line. As shown in dashed lines, the T-shape of the forward brace bar 250 and the rearward brace bar 252 of FIG. 16A can be modified such that a thickness of the flange 141 decreases away from the web 143. In other words, the flange 141 can be thicker nearer the web 143 than further away from the web 143. The angle of divergence $\theta_D$ of the flange 141 can be greater at a bottom end (e.g., 15-degrees) of a brace bar than at a top end (e.g., 5-degrees) of the brace bar. Additionally, the shape, size, or other characteristic of the forward brace bar 250 can be different than that of the rearward brace bar 252. For example, the forward brace bar 250 may be thicker or more massive than the rearward brace bar 252.

In certain implementations, the forward brace bar 250 and the rearward brace bar 252 have an outer diameter of from about 2 mm to about 7 mm, such as from about 3 mm to about 6 mm, or about 4 mm to about 5 mm. According to some implementations, the forward brace bar 250 and the rearward brace bar 252 have a wall thickness of from about 0.25 mm to about 2.5 mm, such as from about 0.3 mm to about 1.5 mm, or from about 0.4 mm to about 1.0 mm, or about 0.5 mm.

The forward brace bar 250 and the rearward brace bar 252 can be co-formed with, coupled to, secured to, or attached to, the golf club head 100. Moreover, each of the forward brace bar 250 and the rearward brace bar 252 is attached at a first end to the sole portion 117 of the body 110 and at a second end to the crown portion 119 of the body 110. More specifically, in the illustrated embodiments, each of the forward brace bar 250 and the rearward brace bar 252 is attached at the first end to the weight tracks of the body 110 and at a second end to the spine portion 240 of the body 110. In some implementations, the first end of both the forward brace bar 250 and the rearward brace bar 252 are attached at only the intermediate weight track 130. However, as shown, in certain implementations, the first end of the forward brace bar 250 is attached at both the intermediate weight track 130 and the front weight track 136 (e.g., including an intersection of the intermediate weight track 130 and the front weight track 136) and the rearward brace bar 252 is attached at both the intermediate weight track 130 and the rear weight track 154 (e.g., including an intersection of the intermediate weight track 130 and the rear weight track 154). Although not shown, in some implementations, the first end of the forward brace bar 250 is attached at only the front weight track 136 and/or the rearward brace bar 252 is attached at only the rear weight track 154. In some implementations, each of the forward brace bar 250 and the rearward brace bar 252 is attached at the second end to the spine portion 240 at a top of the crown portion 119 at locations approximately half way between the face portion 142 and the rearward region 118. In some embodiments, the forward brace bar 250 is attached at a first end to the sole portion 117 of the body 110 at a location forward of the CG 187 and the rearward brace bar 252 is attached at a first end to the sole portion 117 of the body 110 at a location rearward of the CG 187.

In some embodiments, the forward brace bar 250 and the rearward brace bar 252 are aligned substantially parallel with the y-axis 175 of the club head origin coordinate system 185. In other words, the forward brace bar 250 and the rearward brace bar 252 can be spaced apart in a direction parallel to the y-axis 175 and have the same x-axis coordinate. However, as shown in FIG. 12, the forward brace bar 250 and the rearward brace bar 252 are angled with respect to the z-axis 165 of the club head origin coordinate system 185 or a vertical axis. For example, the forward brace bar 250 is angled rearwardly and the rearward brace bar 252 is angled forwardly. In one implementation, the forward brace bar 250 and the rearward brace bar 252 define an angle between 10-degrees and 60-degrees with the z-axis 165.

In the embodiment shown, the forward brace bar 250 and the rearward brace bar 252 are attached to the body 110 via respective internal receptacles or brackets formed in the body 110. In the illustrated embodiment, the body 110 includes a forward sole receptacle 254, a rearward sole receptacle 256, a forward crown receptacle 258, and a rearward crown receptacle 260. The forward sole receptacle 254 and the rearward sole receptacle 256 are coupled to (e.g., co-formed with) the intermediate weight track 130 and the forward crown receptacle 258 and the rearward crown receptacle 260 are coupled to (e.g., co-formed with) the spine portion 240. Each receptacle is configured to matingly receive a respective end of one of the brace bars. For example, the first end of the forward brace bar 250 is matingly received within the forward sole receptacle 254, the second end of the forward brace bar 250 is matingly received within the forward crown receptacle 258, the first end of the rearward brace bar 252 is matingly received within the rearward sole receptacle 256, and the second end of the rearward brace bar 252 is matingly received within the rearward crown receptacle 260. In some embodiments of the golf club head 100, the forward brace bar 250 and the rearward brace bar 252 are secured to the respective receptacles via any of various techniques, such as welding, adhering, bonding, fastening, co-forming, co-casting, co-molding, and the like.

The body 110, the forward brace bar 250, and the rearward brace bar 252 may be constructed of the same or similar materials. However, in some implementations, the forward brace bar 250 and the rearward brace bar 252 may be constructed of materials different than those of the body 110. In one example, the forward brace bar 250 and the rearward brace bar 252 are constructed of a polymer-fiber composite material. Alternatively, the forward brace bar 250 and the rearward brace bar 252 may be formed of a metallic alloy (e.g., titanium alloy, aluminum alloy, steel alloy). The material, size and shape of the forward brace bar 250 and the rearward brace bar 252 results in a mass per unit length of the forward brace bar 250 and the rearward brace bar 252 between 0.005 g/mm and 0.40 g/mm in some embodiments. In certain implementations, for a composite material the mass per unit length of the forward brace bar 250 and the rearward brace bar 252 is between 0.012 g/mm and 0.024 g/mm or between 0.012 g/mm and 0.018 g/mm. For titanium, the mass per unit length of the forward brace bar 250 and the rearward brace bar 252 is about three times these amounts. For steel, the mass per unit length of the forward brace bar 250 and the rearward brace bar 252 is more than five times these amounts. For aluminum, the mass per unit length of the forward brace bar 250 and the rearward brace bar 252 is nearly two times these amounts.

In some embodiments, the forward brace bar 250 and the rearward brace bar 252 are attached to the golf club head 100 so as not to be under a compression or tension load when the golf club head is not in use. In other words, the forward brace bar 250 and the rearward brace bar 252 have supporting dimensions (e.g., lengths) that are the same as the corresponding dimensions of the hollow interior of the body 110 so that the dimensions of the hollow interior would not substantially change (when the golf club head is not in use) even if the brace bars were removed from the body 110.

Although in the illustrated embodiment, the golf club head 100 includes two brace bars extending between the weight tracks and the spine portion 240, the golf club head 100 can include only one or more than two brace bars extending between the weight tracks and the spine portion 240.

Preferably, the overall frequency of the golf club head 100, e.g., the average of the first mode frequencies of the crown, sole and skirt portions of the golf club head 100, generated upon impact with a golf ball is greater than 3,000 Hz. Frequencies above 3,000 Hz provide a user of the golf club head 100 with an enhanced feel and satisfactory auditory feedback. However, a golf club head 100 having a larger volume and/or having relatively thin walls can reduce the first mode vibration frequencies to undesirable levels. The addition of one or both of the forward brace bar 250 and the rearward brace bar 252 described herein can increase the first mode vibration frequencies, thus allowing the first mode frequencies to approach a more desirable level and improving the feel of the golf club head 100 to a user.

Referring to FIGS. 10-12, 14, and 15, the golf club head 100 includes multiple internal reinforcement ribs to provide additional structural support and/or acoustic property tuning. The ribs can have a wide variety of shapes, sizes, orientations, and locations on the interior surface of the body 110. Generally, the ribs are thin-walled structures having a height and length much greater than a thickness. Although the golf club head 100 includes many internal reinforcement ribs, only a few of the internal reinforcement ribs will be described and focused on in more detail herein.

The internal reinforcement ribs of the golf club head 100 include a hosel-brace reinforcement rib 270 that extends continuously between, and is coupled to, a hosel cavity 271 of the hosel 120 and the forward sole receptacle 254. Additionally, the hosel-brace reinforcement rib 270 extends along, and is coupled to, the intermediate weight track 130 and the front weight track 132. In this manner, the hosel-brace reinforcement rib 270 structurally ties together and rigidifies the hosel 120, the intermediate weight track 130, and the forward brace bar 250. As shown in FIGS. 10 and 12, the hosel-brace reinforcement rib 270 is angled relative to the strike face 131. More specifically, the hosel-brace reinforcement rib 270 is angled rearwardly from the hosel cavity 271 to the forward sole receptacle 254.

The internal reinforcement ribs of the golf club head 100 also include an intermediate reinforcement rib 272 that extends along, and is coupled to, the intermediate weight track 130. A portion of the intermediate reinforcement rib 272 extends continuously between, and is coupled to, the forward sole receptacle 254 and the rearward sole receptacle 256. The intermediate reinforcement rib 272 also extends across, and is coupled to, the front weight track 136 and the rear weight track 154. In this manner, the intermediate reinforcement rib 272 structurally ties together and rigidifies the front weight track 136, the intermediate weight track 130, the rear weight track 154, the forward brace bar 250, and the rearward brace bar 252. In one implementation, the intermediate reinforcement rib 272 extends longitudinally in the same direction as the intermediate weight track 130. According to some implementations, the intermediate reinforcement rib 272 can be parallel to the y-axis 175 of the club head origin coordinate system 185.

The internal reinforcement ribs of the golf club head 100 further include a spine reinforcement rib 274 (see, e.g., FIG. 15) that extends along, and is coupled to, the spine portion 240 of the frame 124. A portion of the spine reinforcement rib 274 extends continuously between, and is coupled to, the forward crown receptacle 258 and the rearward crown receptacle 260. The spine reinforcement rib 274 may also extend forwardly of the forward crown receptacle 258 and rearwardly of the rearward crown receptacle 260. In this manner, the spine reinforcement rib 272 structurally ties together and rigidifies the forward brace bar 250, the rearward brace bar 252, and the spine portion 240. In one implementation, the spine reinforcement rib 274 extends longitudinally in the same direction as the spine portion 240. Accordingly, the spine reinforcement rib 274 can be parallel to the y-axis 175 of the club head origin coordinate system 185.

The internal reinforcement ribs of the golf club head 100 additionally include a toe-track reinforcement rib 276 that is directly coupled to the intermediate weight track 130, the front weight track 132, and the sole portion 117 at the toe region 114. In this manner, the toe-track reinforcement rib 276 structurally ties together and rigidifies the intermediate weight track 132 and the front weight track 132. As shown, the toe-track reinforcement rib 276 is angled relative to the strike face 131. More specifically, the toe-track reinforcement rib 276 is angled rearwardly from the front weight track 132 to the intermediate weight track 130. The toe-track reinforcement rib 276 may be directly coupled to the hosel-brace reinforcement rib 270 and the intermediate reinforcement rib 272 at the intermediate weight track 130.

The golf club head 100 of the present disclosure may include other features to promote the performance characteristics of the golf club head 100. For example, the golf club head 100, in some implementations, includes alternative movable weight features similar to those described in more detail in U.S. Pat. Nos. 6,773,360; 7,166,040; 7,452,285; 7,628,707; 7,186,190; 7,591,738; 7,963,861; 7,621,823; 7,448,963; 7,568,985; 7,578,753; 7,717,804; 7,717,805; 7,530,904; 7,540,811; 7,407,447; 7,632,194; 7,846,041; 7,419,441; 7,713,142; 7,744,484; 7,223,180; 7,410,425; and U.S. Pat. No. 7,410,426, the entire contents of each of which are incorporated herein by reference in their entirety.

In certain implementations, for example, the golf club head 100 includes slidable weight features similar to those described in more detail in U.S. Pat. No. 7,775,905 and U.S. Pat. No. 8,444,505; U.S. patent application Ser. No. 13/898,313, filed on May 20, 2013; U.S. patent application Ser. No. 14/047,880, filed on Oct. 7, 2013; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No. 62/020,972, filed on Jul. 3, 2014; Patent Application No. 62/065,552, filed on Oct. 17, 2014; and Patent Application No. 62/141,160, filed on Mar. 31, 2015, the entire contents of each of which are hereby incorporated herein by reference in their entirety.

According to some implementations, the golf club head 100 includes aerodynamic shape features similar to those described in more detail in U.S. Patent Application Publication No. 2013/0123040A1, the entire contents of which are incorporated herein by reference in their entirety.

In certain implementations, the golf club head 100 includes removable shaft features similar to those described in more detail in U.S. Pat. No. 8,303,431, the contents of which are incorporated by reference herein in in their entirety.

According to yet some implementations, the golf club head 100 includes adjustable loft/lie features similar to those described in more detail in U.S. Pat. No. 8,025,587; U.S. Pat. No. 8,235,831; U.S. Pat. No. 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No. 13/686,677, the entire contents of which are incorporated by reference herein in their entirety.

Additionally, in some implementations, the golf club head 100 includes adjustable sole features similar to those described in more detail in U.S. Pat. No. 8,337,319; U.S. Patent Application Publication Nos. 2011/0152000A1, 2011/0312437, 2012/0122601A1; and U.S. patent application Ser. No. 13/686,677, the entire contents of each of which are incorporated by reference herein in their entirety.

According to certain implementations, the golf club head 100 includes variable thickness face portion features similar to those described in more detail in U.S. patent application Ser. No. 12/006,060; and U.S. Pat. Nos. 6,997,820; 6,800,038; and U.S. Pat. No. 6,824,475, which are incorporated herein by reference in their entirety.

In some implementations, the golf club head 100 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620, which are herein incorporated by reference in their entirety.

According to one embodiment, a method of making a golf club head, such as the golf club head 100, includes one or more of the following steps: (1) forming a frame having sole openings, forming a composite laminate sole inserts, injection molding a thermoplastic composite head component over the sole inserts to create a sole insert unit, and joining the sole insert unit to the frame; (2) providing a composite head component, which is a weight track capable of supporting one or more slidable weights; (3) forming sole inserts from a thermoplastic composite material having a matrix; (4) forming a sole insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; (5) forming both a sole insert from thermoplastic composite materials having a compatible matrix; (6) forming a sole insert from a thermosetting material, coating a sole insert with a heat activated adhesive, and forming a weight track from a thermoplastic material capable of being injection molded over the sole insert after the coating step; (7) forming a frame from a material selected from the group consisting of titanium, one or more titanium alloys, aluminum, one or more aluminum alloys, steel, one or more steel alloys, and any combination thereof; (8) forming a frame with one or more crown openings, forming a crown insert from a composite laminate material, and joining the crown insert to the frame such that the crown insert overlies the crown opening(s); (9) selecting a composite head component from the group consisting of one or more ribs to reinforce the head, one or more ribs to tune acoustic properties of the head, one or more weight ports to receive a fixed weight in a sole portion of the golf club head, one or more brace bars, one or more weight tracks to receive a slidable weight, and combinations thereof; (10) forming a sole insert and a crown insert from a continuous carbon fiber composite material; (11) forming a sole insert and a crown insert by thermosetting using materials suitable for thermosetting, and coating the sole insert with a heat activated adhesive; (12) forming a frame from titanium, titanium alloy or a combination thereof to have a crown opening, a sole insert, and a weight track from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; and (13) forming a frame with a crown opening, forming a crown insert from a thermoplastic composite material, and joining the crown insert to the frame such that the crown insert overlies the crown opening.

Additionally, or alternatively, the body 110 and/or the frame 124 may be made of from the following materials: carbon steel, stainless steel (e.g. 17-4 PH stainless steel), alloy steel, Fe—Mn—Al alloy, nickel-based ferroalloy, cast iron, super alloy steel, aluminum alloy, magnesium alloy, copper alloy, titanium alloy or mixtures thereof. The sole insert, crown insert, and/or sliding weight track may be formed of a non-metal material with a density less than about 2 g/cm$^3$, such as between about 1 g/cm$^3$ to about 2 g/cm$^3$. The nonmetal material may be preferably comprised of a polymer or polymer reinforced composite. The polymer can be either thermoset or thermoplastic, and can be amorphous, crystalline and/or a semi-crystalline structure. The polymer may also be formed of an engineering plastic such as a crystalline or semi-crystalline engineering plastic or an amorphous engineering plastic. Potential engineering plastic candidates include polyphenylene sulfide ether (PPS), polyetherimide (PEI), polycarbonate (PC), polypropylene (PP), acrylonitrile-butadience styrene plastics (ABS), polyoxymethylene plastic (POM), nylon 6, nylon 6-6, nylon 12, polymethyl methacrylate (PMMA), polypheylene oxide (PPO), polybothlene terephthalate (PBT), polysulfone (PSU), polyether sulfone (PES), polyether ether ketone (PEEK) or mixtures thereof. Besides, during forming the sole insert, crown insert, and/or sliding weight track, organic short fibers, such as fiberglass, carbon fiber, or metallic fiber, can be added into the engineering plastic, so as to enhance the structural strength of the sole insert, crown insert, and/or sliding weight track. Preferably, however, the reinforcements are continuous long fibers, rather than short fibers. The most preferable thermoset would be continuous long fiber graphite epoxy composite. The most preferable thermoplastics would be either PPS or PSU polymer with continuous long fiber graphite reinforcements. One of the advantages of epoxy and PSU is both are relatively stiff with relatively low damping which produces a better sounding or more metallic sounding golf club compared to other polymers which may be overdamped. Additionally, PSU requires less post processing in that it does not require a finish or paint to achieve a final finished golf club head.

Exemplary polymers for the embodiments described herein may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures.

These polymers include the polysulfones, the polyetherimides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-SO2-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially important polysulfones are a) polysulfone (PSU); b) Polyethersulfone (PES also referred to as PESU); and c) Polyphenylene sulfoner (PPSU).

Particularly important and preferred aromatic polysulfones are those comprised of repeating units of the structure —C6H4SO2-C6H4-O— where C6H4 represents a m- or p-phenylene structure. The polymer chain can also comprise repeating units such as —C6H4-, C6H4-O—, —C6H4-(lower-alkylene)-C6H4-O—, —C6H4-O—C6H4-O—, —C6H4-S—C6H4-O—, and other thermally stable substantially-aromatic difunctional groups known in the art of engineering thermoplastics. Also included are the so called modified polysulfones where the individual aromatic rings are further substituted in one or substituents including

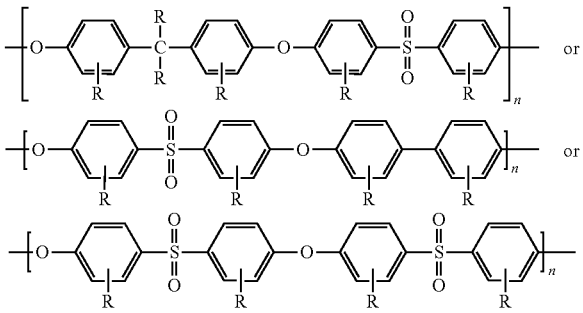

or or wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a C1-C20 alkyl group, a C2-C20 alkenyl group, a C3-C20 cycloalkyl group, a C3-C20 cycloalkenyl group, and a C6-C20 aromatic hydrocarbon group. These hydrocarbon groups may be partly substituted by a halogen atom or atoms, or may be partly substituted by a polar group or groups other than the halogen atom or atoms. As specific examples of the C1-C20 alkyl group, there can be mentioned methyl, ethyl, propyl, isopropyl, amyl, hexyl, octyl, decyl and dodecyl groups. As specific examples of the C2-C20 alkenyl group, there can be mentioned propenyl, isopropepyl, butenyl, isobutenyl, pentenyl and hexenyl groups. As specific examples of the C3-C20 cycloalkyl group, there can be mentioned cyclopentyl and cyclohexyl groups. As specific examples of the C3-C20 cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers include (a) the polysulfone made by condensation polymerization of bisphenol A and 4,4'-dichlorodiphenyl sulfone in the presence of base, and having the main repeating structure

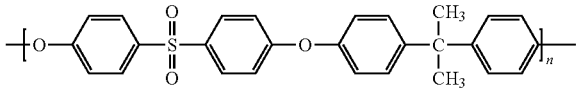

and the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure

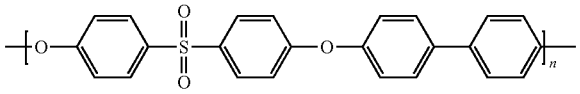

and the abbreviation PPSF and sold under the tradenames RADEL® resin; and (c) a condensation polymer made from 4,4'-dichlorodiphenyl sulfone in the presence of base and having the principle repeating structure

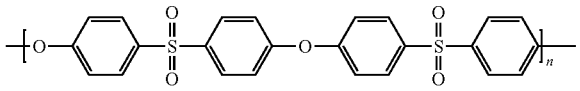

and the abbreviation PPSF and sometimes called a "polyether sulfone" and sold under the tradenames Ultrason® E, LNP™, Veradel® PESU, Sumikaexce, and VICTREX® resin," and any and all combinations thereof.

In some embodiments, a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. patent application Ser. No. 10/442,348 (now U.S. Pat. No. 7,267,620), Ser. No. 10/831,496 (now U.S. Pat. No. 7,140,974), Ser. No. 11/642,310, 11/825,138, 11/998,436, 11/895,195, 11/823,638, 12/004,386, 12/004,387, 11/960,609, 11/960,610, and Ser. No. 12/156,947, which are incorporated herein by reference. The composite material may be manufactured according to the methods described at least in U.S. patent application Ser. No. 11/825,138, the entire contents of which are herein incorporated by reference.

Alternatively, short or long fiber-reinforced formulations of the previously referenced polymers can be used. Exemplary formulations include a Nylon 6/6 polyamide formulation, which is 30% Carbon Fiber Filled and available commercially from RTP Company under the trade name RTP 285. This material has a Tensile Strength of 35000 psi (241 MPa) as measured by ASTM D 638; a Tensile Elongation of 2.0-3.0% as measured by ASTM D 638; a Tensile Modulus of 3.30×106 psi (22754 MPa) as measured by ASTM D 638; a Flexural Strength of 50000 psi (345 MPa) as measured by ASTM D 790; and a Flexural Modulus of 2.60×106 psi (17927 MPa) as measured by ASTM D 790.

Other materials also include is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Yet other materials include is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

Especially preferred materials include a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Also, preferred materials may include a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Further preferred materials include a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

According to some embodiments, to use the adjustable weight systems of the golf club head 100, a user will use an engagement end of a tool (such as the torque wrench) to loosen the weight assembly 132. Once the weight assembly 132 is loosened, the weight assembly may be adjusted by either sliding the weight assembly in a channel or by repositioning the weight assembly at different locations on the club head. Once the weight assembly is in the desired location, the weight assembly may be tightened until the weight assembly is secured to the club head. In the case of a sliding weight, the weight fastening bolt may be tightened until the clamping force, between inner and outer components, upon a front ledge and/or rear ledge of a weight track or channel is sufficient to restrain the weight assembly in place. In some embodiments, the golf club head 100 may include locking projections located on the front ledge and/or rear ledge and locking notches located on the washer that cooperate to increase the locking force provided by the inner component and the outer component. In other embodiments, the golf club head 100 may include locating projections located on the front ledge and/or rear ledge and locating notches located on the inner and/or outer component. The locating projections or bumps are sized to have a width smaller than the width of the notches or recesses in the outer component such that the outer weight member can move a limited amount when placed over one of the bumps. In this manner, the projections or bumps serve as markers or indices to help locate the position of the weight assembly along the channel, but do not perform a significant locking function. Instead, the weight assembly may be locked into place at a selected position along the channel by tightening the weight assembly.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A golf club head, comprising:

a body, defining an interior cavity and comprising:

a sole portion, positioned at a bottom portion of the golf club head;

a crown portion, positioned at a top portion of the golf club head;

a skirt portion, positioned around a periphery of the golf club head between the sole portion and the crown portion;

a forward region;

a rearward region;

a face portion, at the forward region of the body and comprising a strike face with an area of at least 3000 mm^2 and a maximum height from a ground plane of at least about 50 mm; and at least one weight track formed in the sole portion;

at least one weight assembly, selectively adjustably positioned within the at least one weight track; and at least one brace bar traversing the interior cavity between and attached to the at least one weight track and the crown portion, wherein a mass per unit length of the brace bar is between 0.005 g/mm and 0.40 g/mm;

wherein:

the body further comprises a frame;

the frame comprises a first crown opening, a second crown opening, and a spine portion defining the crown portion and separating the first crown opening from the second crown opening;

the crown portion comprises a crown insert attached to the spine portion and covering the first crown opening and the second crown opening; and the at least one brace bar is attached to the spine portion.

2. The golf club head according to claim 1, wherein:

the frame further comprises a first receptacle co-formed with the at least one weight track and a second receptacle co-formed with the spine portion; and the at least one brace bar is received within and attached to the first receptacle and the second receptacle.

3. The golf club head according to claim 2, wherein:

the golf club head further comprises a hosel coupled to body; and the body further comprises a hosel-brace reinforcement rib within the interior cavity of the body and extending continuously between, and coupled directly to, the hosel and the first receptacle.

4. The golf club head according to claim 2, wherein the body further comprises a spine reinforcement rib within the interior cavity of the body and extending along and coupled directly to the spine portion of the frame and the second receptacle.

5. The golf club head according to claim 1, wherein:

the at least one brace bar comprises a forward brace bar and a rearward brace bar; and the forward brace bar and the rearward brace bar are spaced apart and aligned in a forward-to-rearward direction.

6. The golf club head according to claim 5, wherein:

the forward brace bar is angled rearwardly relative to a vertical axis; and the rearward brace bar is angled forwardly relative to the vertical axis.

7. The golf club head according to claim 6, wherein:

the at least one weight track comprises a front weight track, extending in a heel-to-toe direction substantially parallel with the strike face of the face portion;

the at least one weight track further comprises an intermediate weight track, extending in a front-to-rear direction substantially perpendicular to the strike face of the face portion and separating a first sole opening of the body from a second sole opening of the body;

the at least one weight track further comprises a rear weight track, extending at angle relative to the intermediate weight track;

the forward brace bar is attached to an intersection between the front weight track and the intermediate weight track at a location forward of a center-of-gravity of the golf club head; and the rearward brace bar is attached to an intersection between the intermediate weight track and the rear weight track at a location rearward of the center-of-gravity of the golf club head.

8. The golf club head according to claim 1, wherein:

the at least one weight track comprises an intermediate weight track, extending in a front-to-rear direction substantially perpendicular to the strike face of the face portion and separating a first sole opening of the body from a second sole opening of the body;

the at least one weight track further comprises a rear weight track, extending at angle relative to the intermediate weight track; and the brace bar is attached to at least the intermediate weight track.

9. The golf club head according to claim 1, wherein:

the frame is made of a metal alloy; and the crown insert is made of a fiber-reinforced polymer.

10. The golf club head according to claim 1, wherein:

the frame further comprises a first sole opening and a second sole opening defining the sole portion of the body; and the sole portion comprises a first sole insert attached to the frame and covering the first sole opening and a second sole insert attached to the frame and covering the second sole opening.

11. The golf club head according to claim 10, wherein:

the first sole insert overhangs the at least one weight track; and the second sole insert overhangs the at least one weight track.

12. The golf club head according to claim 11, wherein:

the at least one weight track comprises an intermediate weight track, extending in a front-to-rear direction substantially perpendicular to the strike face of the face portion and separating the first sole opening from the second sole opening;

the first sole insert overhangs the intermediate weight track; and the second sole insert overhangs the intermediate weight track.

13. The golf club head according to claim 12, wherein:

the at least one weight track comprises a front weight track, extending in a heel-to-toe direction substantially parallel with the strike face of the face portion;

the first sole insert overhangs the front weight track; and the second sole insert overhangs the front weight track.

14. The golf club head according to claim 1, wherein:

the at least one weight track comprises a ledge;

the at least one weight assembly consists of an inner component and an outer component; and the at least one weight assembly is configured to clamp the ledge between the inner component and the outer component.

15. The golf club head according to claim 1, wherein the head further comprises a coefficient of restitution (COR) feature formed in the sole portion of the body between the face portion and the at least one weight track.

16. The golf club head according to claim 15, wherein:

the at least one weight track comprises an intermediate weight track, extending in a front-to-rear direction substantially perpendicular to the strike face of the face portion and separating a first sole opening of the body from a second sole opening of the body; and the COR feature comprises a channel between the face portion and the intermediate weight track and extending perpendicular to the intermediate weight track.

17. The golf club head according to claim 1, wherein the at least one weight assembly is selectively adjustable to adjust:

a CGy coordinate of the golf club head within a range of adjustability of between 3 mm and 8 mm;

a CGx coordinate of the golf club head within a range of adjustability of between 2 mm and 8 mm; and a CGz coordinate of the golf club head within a range of adjustability of no more than 2 mm.

18. The golf club head according to claim 1, wherein the at least one weight assembly is a two-piece weight assembly for installing within the at least one weight track of the golf club head, the two-piece weight assembly consisting of:

an inner component comprising an anchor element and a mating element, wherein the anchor element is round; and an outer component, comprising a head element that has a non-circular shape, wherein the mating element of the inner component is rotatably mateable with the outer component to adjust a distance between the anchor element of the inner component and the head element of the outer component.

19. The golf club head according to claim 18, wherein:

the outer component further comprises a boss protruding from the head element;

the boss is positioned between the head element and the anchor element when the mating element of the inner component is rotatably mated with the outer component; and the boss is non-round.

20. The golf club head according to claim 18, wherein the head element of the outer component comprises a plurality of alternating recesses and tabs.

21. A golf club head, comprising:

a body, defining an interior cavity and comprising:

a sole portion, positioned at a bottom portion of the golf club head;

a crown portion, positioned at a top portion of the golf club head;

a skirt portion, positioned around a periphery of the golf club head between the sole portion and the crown portion;

a forward region;

a rearward region;

a face portion, at the forward region of the body and comprising a strike face with an area of at least 3000 mm^2 and a maximum height from a ground plane of at least about 50 mm; and at least one weight track formed in the sole portion;

at least one weight assembly, selectively adjustably positioned within the at least one weight track; and at least one brace bar traversing the interior cavity between and attached to the at least one weight track and the crown portion, wherein a mass per unit length of the brace bar is between 0.005 g/mm and 0.40 g/mm;

wherein:

the at least one weight assembly is a two-piece weight assembly for installing within the at least one weight track of the golf club head, the two-piece weight assembly consisting of:

an inner component comprising an anchor element and a mating element, wherein the anchor element is round; and an outer component, comprising a head element that has a non-circular shape, wherein the mating element of the inner component is rotatably mateable with the outer component to adjust a distance between the anchor element of the inner component and the head element of the outer component;

the inner component further comprises a neck between the anchor element and the mating element; and the neck has a maximum width that is less than that of the anchor element and the mating element.

22. A golf club head, comprising:

a body, defining an interior cavity and comprising:

a sole portion, positioned at a bottom portion of the golf club head;

a crown portion, positioned at a top portion of the golf club head;

a skirt portion, positioned around a periphery of the golf club head between the sole portion and the crown portion;

a forward region;

a rearward region;

a face portion, at the forward region of the body and comprising a strike face with an area of at least 3000 mm^2 and a maximum height from a ground plane of at least about 50 mm; and at least one weight track formed in the sole portion;

at least one weight assembly, selectively adjustably positioned within the at least one weight track; and at least one brace bar traversing the interior cavity between and attached to the at least one weight track and the crown portion, wherein a mass per unit length of the brace bar is between 0.005 g/mm and 0.40 g/mm;

wherein:

the at least one weight assembly is a two-piece weight assembly for installing within the at least one weight track of the golf club head, the two-piece weight assembly consisting of:

an inner component comprising an anchor element and a mating element, wherein the anchor element is round; and an outer component, comprising a head element that has a non-circular shape, wherein the mating element of the inner component is rotatably mateable with the outer component to adjust a distance between the anchor element of the inner component and the head element of the outer component;

the mating element comprises external threads and a tool engagement socket;

the outer component comprises an aperture extending entirely through the outer component; and the aperture comprises internal threads threadably engageable with the external threads of the mating element.

* * * * *